US012613076B1

(12) United States Patent
Maschin et al.

(10) Patent No.: US 12,613,076 B1
(45) Date of Patent: Apr. 28, 2026

(54) PNEUMATIC LAUNCHING APPARATUS EMPLOYING BARREL CAM DRIVING PATHWAYS AND METHODS

(71) Applicant: Hasbro, Inc., Pawtucket, RI (US)

(72) Inventors: Robert C Maschin, Johnston, RI (US); Nicholas Alexander Tino, Seekonk, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 18/819,538

(22) Filed: Aug. 29, 2024

Related U.S. Application Data

(60) Provisional application No. 63/536,761, filed on Sep. 6, 2023.

(51) Int. Cl.
*F41B 11/89* (2013.01)
*F41B 11/52* (2013.01)
*F41B 11/682* (2013.01)

(52) U.S. Cl.
CPC ..... *F41B 11/89* (2013.01); *F41B 11/52* (2013.01); *F41B 11/682* (2013.01)

(58) Field of Classification Search
CPC ..... F41B 4/00; F41B 11/642; F41B 11/89; F41B 11/52; F41B 11/54; F41B 11/723; F41B 11/55; F41B 11/641; F41B 11/62
USPC ..... 124/56, 59, 66, 51.1, 82, 73, 78, 65, 50
See application file for complete search history.

(56) References Cited

U.S. PATENT DOCUMENTS

| | | | |
|---|---|---|---|
| 46,617 | A | 3/1865 | Allen |
| 159,609 | A | 2/1875 | Prescott |
| 956,760 | A | 5/1910 | Moulin |
| 1,441,975 | A | 1/1923 | Edelin |
| 1,488,995 | A | 4/1924 | McCollom |
| 1,743,576 | A | 1/1930 | Smith |
| 1,873,677 | A | 8/1932 | Traver |
| 2,214,224 | A | 9/1940 | Douglas |
| 2,483,752 | A | 10/1949 | Buhl |
| 2,634,717 | A | 4/1953 | Junkin |
| 2,725,868 | A | 12/1955 | Foster |
| 2,737,942 | A | 3/1956 | Horowitz et al. |
| 3,054,536 | A | 9/1962 | Sagarin |
| 3,262,440 | A | 7/1966 | Kuhn |
| 3,385,279 | A | 5/1968 | Pitcher |
| 3,420,133 | A | 1/1969 | Proll |
| 3,584,614 | A | 6/1971 | Horvath |
| 3,847,132 | A | 11/1974 | Schatz |
| 3,990,426 | A | 11/1976 | Stokes |
| 4,094,294 | A | 6/1978 | Speer |
| 4,345,578 | A | 8/1982 | Speer |

(Continued)

*Primary Examiner* — Michael D David
(74) *Attorney, Agent, or Firm* — Perry Hoffman

(57) ABSTRACT

Launcher apparatus and methods of a toy projectile blaster piston air compression element and breech bolt operating through a barrel cam peripheral surface with a cylinder cam pathway track and piston cam pathways for driving contact and respective piston and cylinder timings. The barrel cam is rotatably disposed. Piston and cylinder follower ends contact the barrel cam pathways generating fluid communication to outwardly launch received projectile rounds. The breech can receive projectiles with the breech bolt of the air compression element extending into the breech to position a received projectile through the barrel seal, and a source of rotary motion or forward strokes and back strokes fires the projectiles.

20 Claims, 22 Drawing Sheets

(56) References Cited

U.S. PATENT DOCUMENTS 4,597,527 A 7/1986 Sands
4,774,929 A 10/1988 Millman
4,841,945 A 6/1989 Braden
4,890,404 A 1/1990 Ferri
5,205,271 A 4/1993 Salva
5,244,153 A 9/1993 Kuhn et al.
5,267,549 A 12/1993 Webber
5,343,850 A 9/1994 Steer
5,471,967 A 12/1995 Matsuzaki et al.
5,529,050 A 6/1996 D'Andrade
5,535,729 A 7/1996 Griffin et al.
5,678,528 A * 10/1997 Hadley ..... F41B 5/12 124/25.5
5,704,150 A 1/1998 Millman
5,878,734 A 3/1999 Johnson et al.
6,119,671 A 9/2000 Smith et al.
6,460,530 B1 10/2002 Backeris et al.
6,488,019 B2 12/2002 Kotsiopoulos
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,371,282 B2 2/2013 Meggs et al.
8,397,705 B2 3/2013 DeHaan et al.
8,567,378 B2 10/2013 Nugent
8,640,683 B2 2/2014 Meggs et al.
8,695,579 B2 4/2014 Huebl
8,875,688 B2 11/2014 Nugent
9,097,476 B2 8/2015 Mead et al.
9,097,477 B1 8/2015 Mead et al.
9,389,042 B1 7/2016 Clayton
9,500,436 B2 11/2016 Macy
9,958,230 B1 5/2018 Nugent et al.
10,488,143 B2 11/2019 Victor et al.
10,488,148 B2 11/2019 Johnson et al.
10,823,527 B2 11/2020 Tino et al.
10,876,809 B1 12/2020 Kopman et al.
10,907,929 B2 2/2021 Bernal
D963,073 S * 9/2022 Maschin ..... D21/573
D1,032,750 S * 6/2024 Maschin ..... D21/573
D1,072,967 S * 4/2025 Maschin ..... D21/573
D1,090,728 S * 8/2025 Maschin ..... D21/573
D1,090,731 S * 8/2025 Maschin ..... D21/573
12,422,214 B1 * 9/2025 Maschin ..... F41B 11/641
12,442,617 B2 * 10/2025 Faecher ..... F41B 11/54
12,449,228 B1 * 10/2025 Maschin ..... F41B 11/642
2002/0166551 A1 11/2002 Lee
2007/0034197 A1 2/2007 Tschech
2009/0095272 A1 4/2009 Zimmerman
2009/0145412 A1 6/2009 Barish
2010/0206281 A1 8/2010 Kanitz et al.
2013/0112184 A1 5/2013 Corsiglia et al.
2013/0146043 A1 6/2013 Zarecky et al.
2013/0312722 A1 11/2013 Price
2014/0090630 A1 * 4/2014 Bird ..... A63H 33/009 124/31
2015/0314210 A1 * 11/2015 Lama ..... A63H 33/062 446/128
2015/0314211 A1 * 11/2015 Lama ..... A63H 3/46 446/128
2015/0314212 A1 * 11/2015 Hamel ..... A63H 33/086 446/128
2016/0018184 A1 1/2016 Park
2020/0300576 A1 * 9/2020 Tino ..... F41B 11/72
2021/0102769 A1 * 4/2021 DeRoche ..... F41A 9/02
2022/0282943 A1 * 9/2022 DeRoche ..... F41B 7/08

* cited by examiner

PNEUMATIC LAUNCHING APPARATUS EMPLOYING BARREL CAM DRIVING PATHWAYS AND METHODS

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, for discharging plural projectile rounds in a novel fashion providing barrel cam pathways for driving contact and respective piston and cylinder timings through piston and cylinder followers in contact for tracking through the barrel cam pathways.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring and a piston and cylinder arrangement to generate the energy and direct that energy to cause the projectile to discharge. The launching apparatus themselves come in various forms, including those simulating rifles, guns, machine gun, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

The inventions discussed in connection with the described embodiments address these and other deficiencies of the prior art. The features and advantages of the present inventions will be explained in or become apparent from the following summary and description of the preferred embodiments considered together with the accompanying drawings. The projectiles for such launching apparatus include soft foam darts of various designs and sizes, foam balls, also of various sizes, and other soft projectiles.

SUMMARY OF THE INVENTION

In accordance with the present invention, an advantageous method and apparatus are provided in the form of a toy launch apparatus designed to discharge soft projectiles, with an advantageous method and system described with novel barrel cam pathways for driving contact and respective piston and cylinder timings through piston and cylinder followers in contact for tracking through the barrel cam pathways.

Briefly summarized, the inventions relate to a toy launching apparatus capable of launching projectile rounds driven from piston air compression and breech bolt elements operating through a barrel cam peripheral surface with a cylinder cam pathway track and piston cam pathways with followers in contact for respective piston and cylinder timings. The barrel cam is rotatably disposed using a mechanism for turning the barrel cam assembly. Piston and cylinder follower ends contact the barrel cam pathways generating fluid communication to outwardly launch received projectile rounds. The breech can receive projectiles with the breech bolt of the air compression element extending into the breech to position a received projectile through the barrel seal, and a source of rotary motion or forward strokes and back strokes fires the projectiles.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
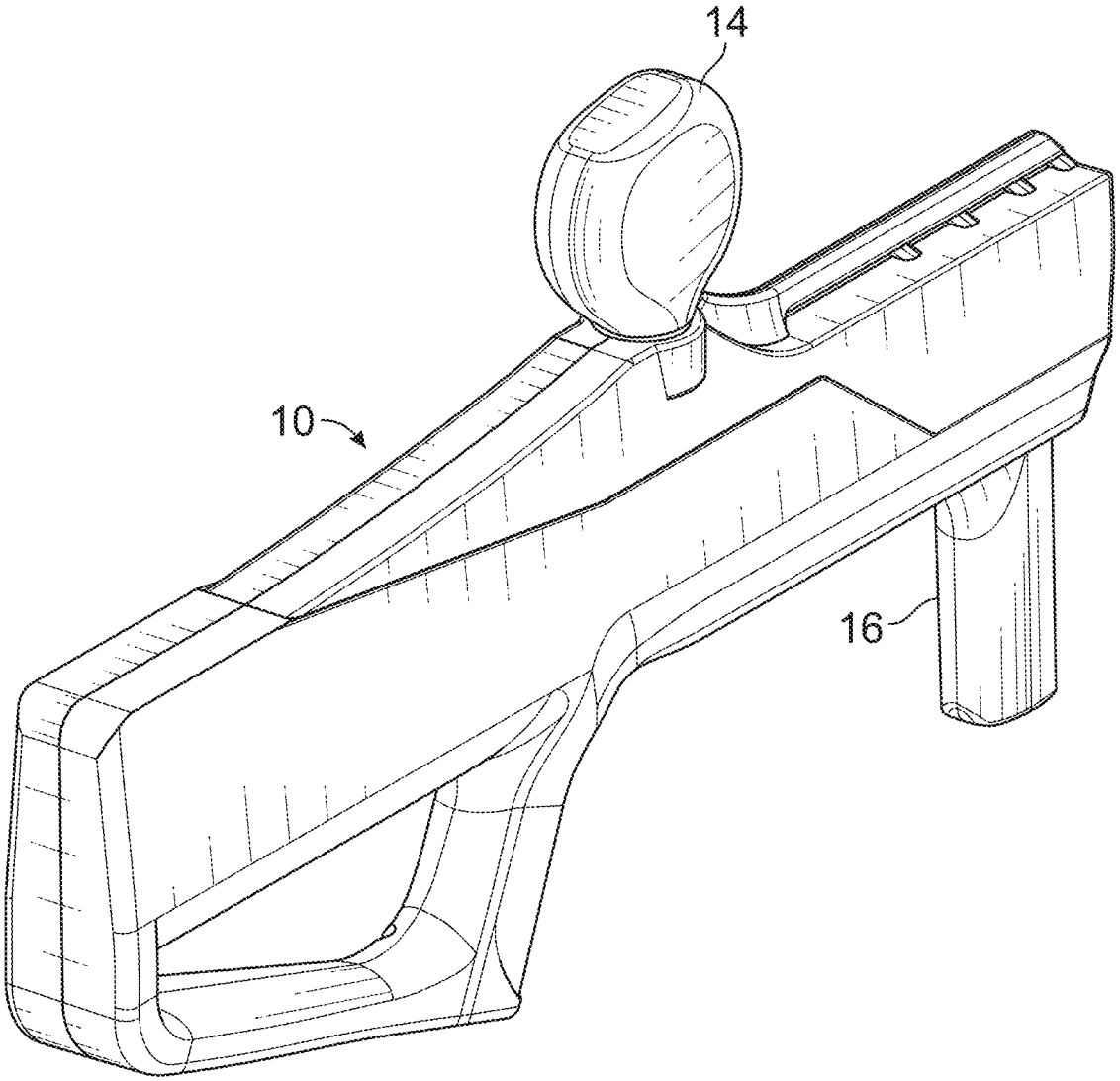
FIG. 1 is an isometric view of an assembled pneumatic launching toy projectile blaster embodiment with a projectile rounds hopper employing a user operated handle mechanism to fire projectile in accordance with the present invention in the form of blasters.

FIG. 1 shows the outside of blaster 10 fully assembled. The blaster 10 has a hopper 14 that stores projectile rounds and a handle 16 that is operated by the user to fire projectile rounds.

Figure 2:
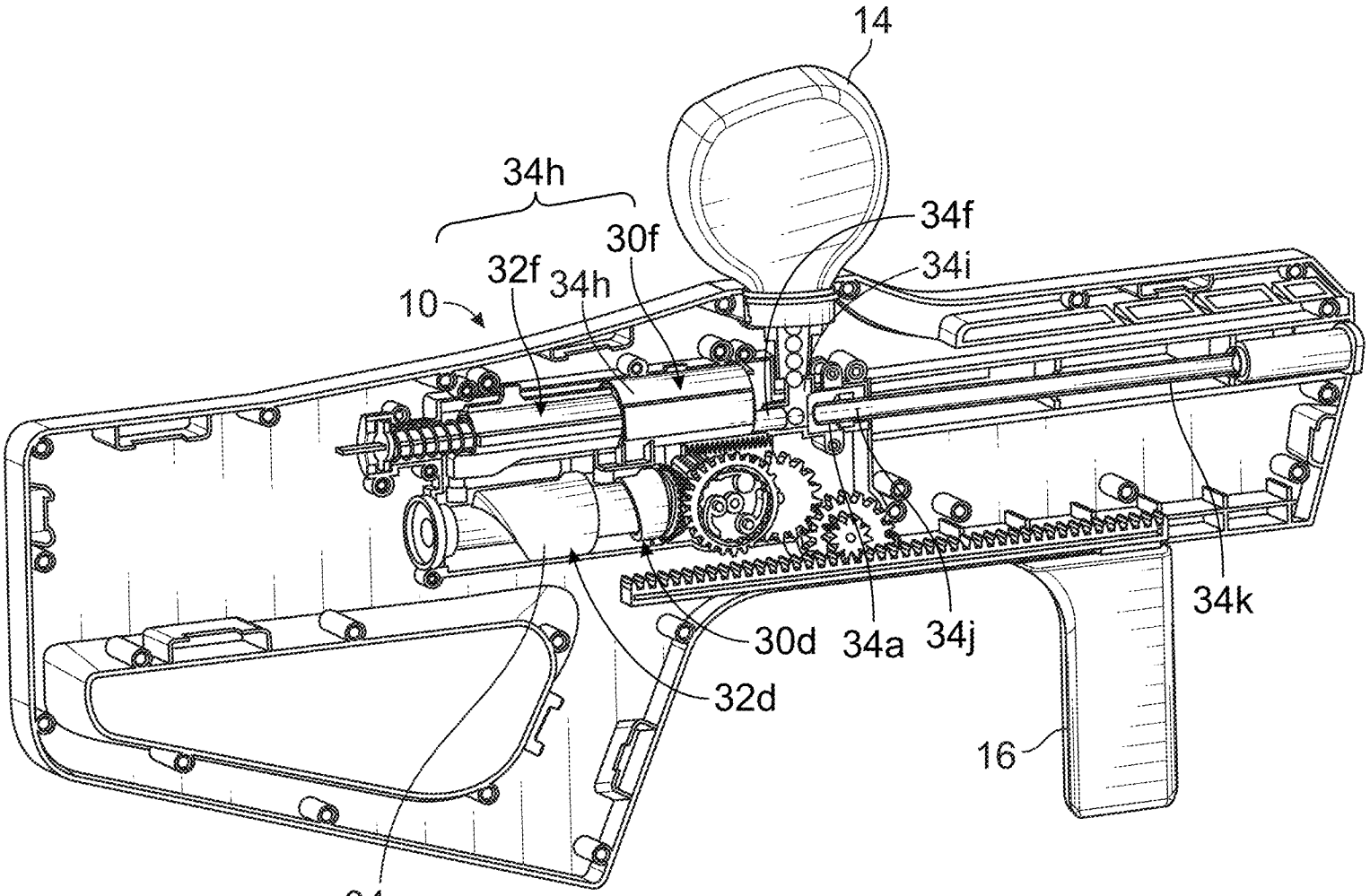
FIGS. 2 and 3 are a half-plane views of the blaster embodiment showing an internal firing mechanism subassembly with FIGS. 4, 5, 6, and 7 showing exploded views of the firing mechanism enabling toy projectile rounds to enter the pre-firing area, with pneumatic launching functions performed by an air compression element and piston.

FIG. 2 shows a half-plane view of blaster 10 fully assembled. The firing mechanism first uses a system of gears to convert the linear motion of the handle 16 in either direction into clockwise rotary motion facing proximal of the barrel cam 34*n*. This motion conversion allows both back and forward strokes to fire projectile rounds using the same system of cams and followers. The barrel cam peripheral surface with a cylinder cam pathway track and piston cam pathways for driving contact and respective piston and cylinder timings. The barrel cam is rotatably disposed. Piston and cylinder follower ends contact the barrel cam pathways generating fluid communication to outwardly launch received projectile rounds. The breech can receive projectiles with the breech bolt of the air compression element extending into the breech to position a received projectile through the barrel seal, and a source of rotary motion or forward strokes and back strokes fires the projectiles.

The barrel cam 34*n* contains the cylinder cam 30*d*, and piston cam 32*d*. These cams are tracked by their respective cylinder follower 30*f* and piston follower 32*f*. The air compression element 34*h* is comprised of the cylinder follower 30*f* and the breech bolt 34*f*. The cylinder cam and follower are responsible for advancing and retracting the breech bolt 34*f* into and from the breech 34*i*. The breech bolt 34*f* must advance into the breech 34*i* to fire projectile rounds but must be retracted for projectile rounds to enter the breech 34*i*. The piston cam and follower are responsible for pneumatically firing the projectile rounds. The cams are responsible for timing the motion of the breech bolt 34*f* and firing the projectile round within the breech 34*i*.

Just prior to firing, the breech bolt 34*f* advances into breech 34*i*. This advancement prevents any further projectile rounds 38 from entering breech 34*i* and moves the projectile rounds through the breech bolt seal 34*a*. During firing, the piston follower 32*e* is quickly received by the cylinder follower 30*e*. When this occurs, pressure greatly increases within the air compression element 34*h*, and air is quickly expelled through the fluid communication channel 34*j*. The projectile round is pneumatically expelled through the barrel 34*k*. After firing, the air compression element 34*h* and piston follower 32*e* retract. The retraction of the air compression element 34*h* causes the breech bolt 34*f* to retract from the breech 34*i*. Therefore, projectile rounds may enter the breech 34*i*. The firing cycle may repeat.

Figure 3:
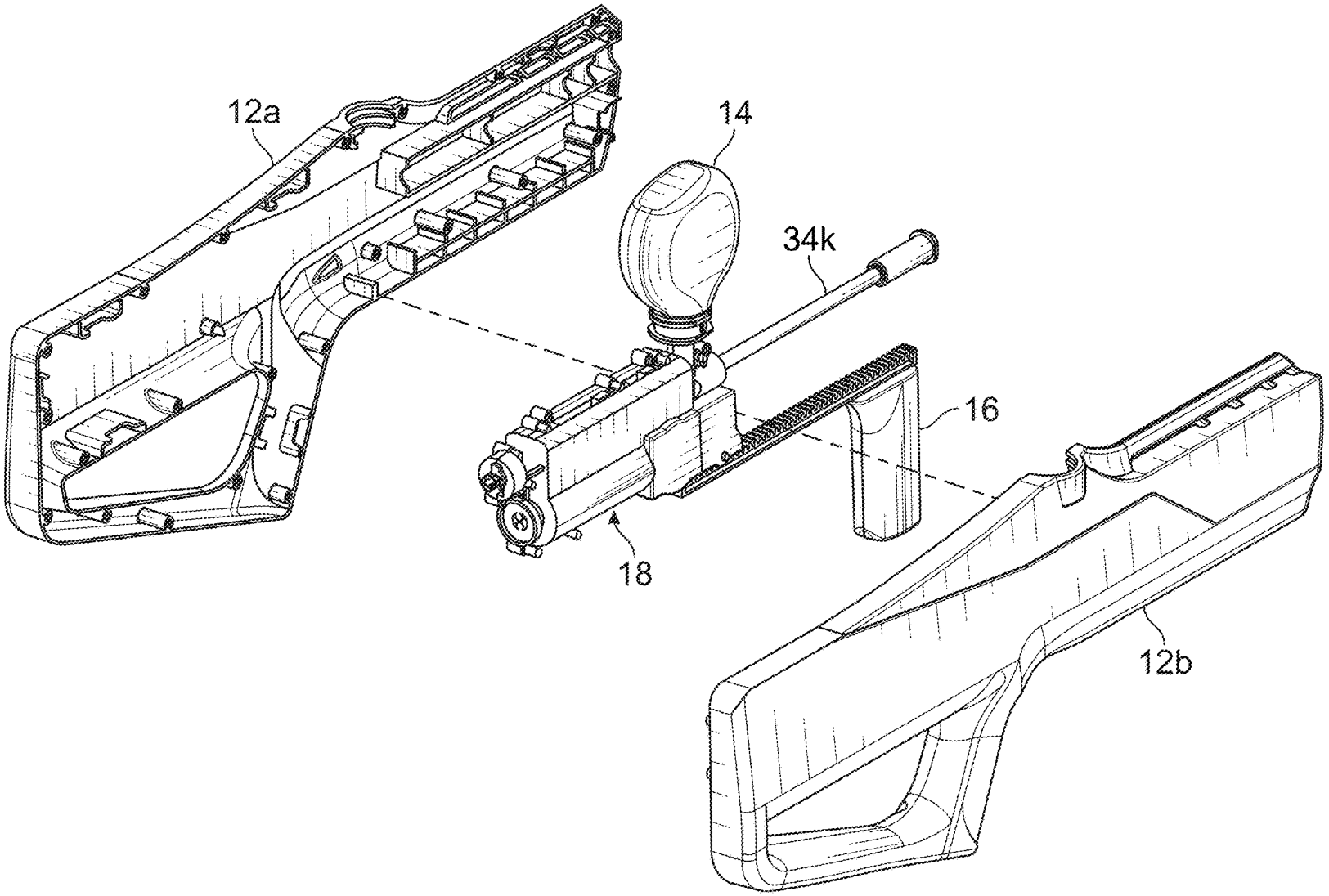

FIGS. 2 and 3 are a half-plane views of the blaster embodiment showing an internal firing mechanism subassembly with FIGS. 4 through 7 showing exploded views of the firing mechanism enabling toy projectile rounds to enter the pre-firing area. Pneumatic launching functions are performed by the air compression element and piston for discharging plural projectile rounds using barrel cam pathways for driving contact and respective piston and cylinder timings through piston and cylinder followers in contact for tracking through the barrel cam pathways.

FIG. 3 shows an exploded view of blaster 10 with the firing mechanism 18 unexploded. The firing mechanism 18 is housed by the left firing mechanism structural 12*a* and the right firing mechanism structural housing 12*b*. The firing mechanism 18 fires the projectile rounds 38 through the barrel 34*k*.

Figure 4:
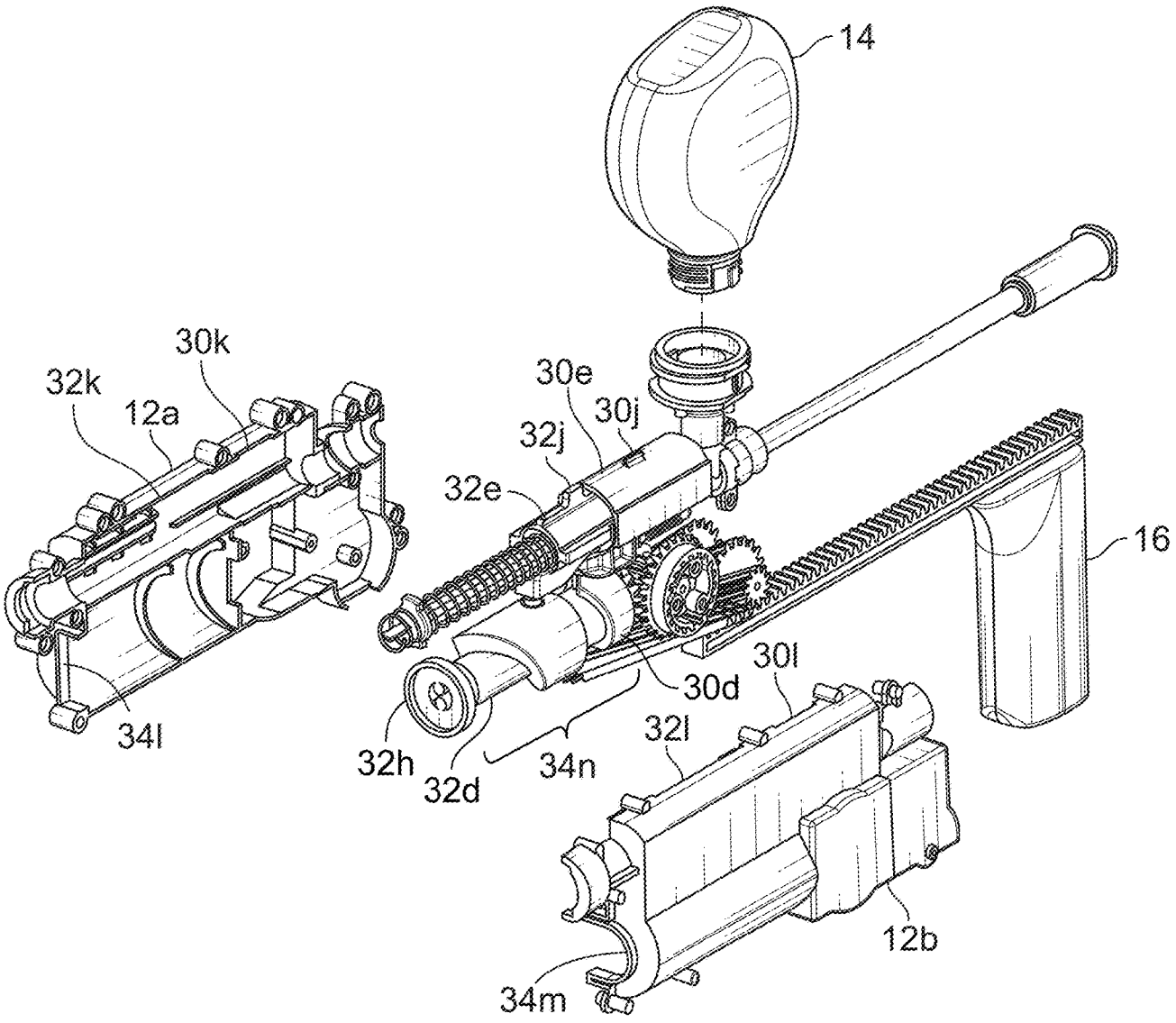

FIG. 4 shows a partially exploded view of the firing mechanism 18. The followers are constrained to translate longitudinally by the firing mechanism housing. The cylinder follower 30*e* has cylinder follower tab 30*j* that is constrained by the cylinder follower left indent 30*k* and the cylinder follower right indent 30*l*. Likewise, the piston follower 32*e* has piston follower tab 32*j* that is constrained by the piston follower left indent 32*k* and the piston follower right indent 32*l* Additionally, the end cap shaft coupling 32*h* is constrained by the left end cap indent 34*l* and the right end cap indent 34*m* to only rotate.

Figure 5:
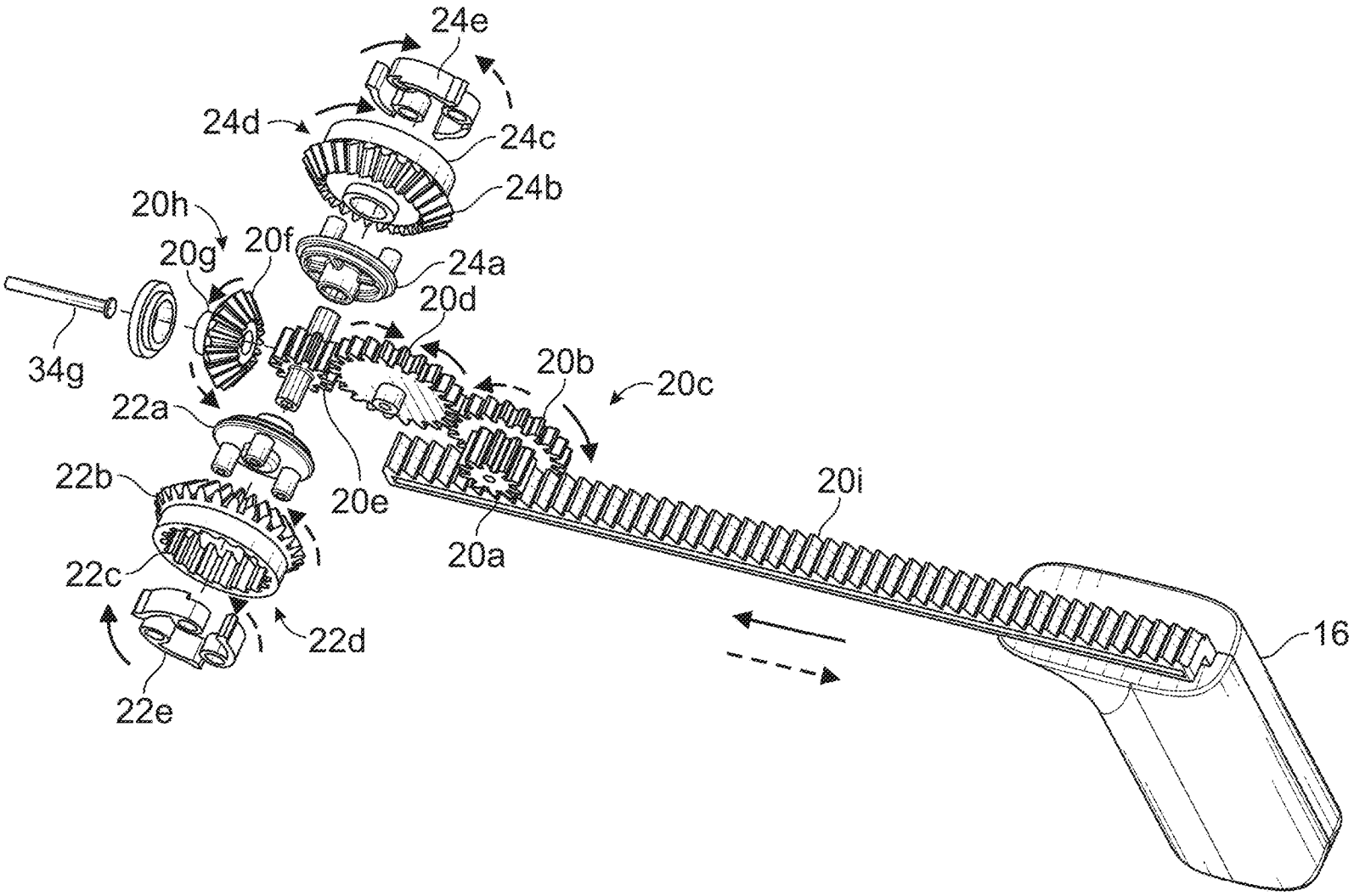

FIG. 5 shows the components of the firing mechanism 18 that converts linear motion of the handle 16 in either direction to rotary motion in a single direction. Both forward and back strokes will result in the clockwise rotation of the cams facing proximal. The mechanism contains gears and rachets whose direction of rotation, or lack of rotation, depends on the direction of motion of the handle 16. The dashed arrows show the direction of motion of the gears and rachets during forward strokes. Likewise, the solid arrows show the direction of motion of the gears and rackets during back strokes.

The rack 20*i* contained within or driven by the handle 16 engages the small pinion gear 20*a*. The small pinion gear 20*a* and large pinion gear 20*b* form the first pinion gear 20*c* integral component. The large pinion gear 20*b* engages the third pinion gear 20*d* which in turn engages the middle transfer gear 20*e*. These gears form a transmission that turn linear motion of the handle 16 to rotary motion of the middle transfer gear 20*e* in both directions. The middle transfer gear 20*e* will turn counterclockwise facing left if the handle goes through a forward stroke and clockwise facing left if the handle goes through a back stroke.

The remaining components shown in FIG. 5 convert rotary motion in either direction to rotary motion in one direction. There are components to the left and right of the middle transfer gear 20*e*. The left side converts clockwise rotation facing left of the middle transfer gear 20*e* into clockwise rotation facing proximal of the middle crown gear 20*f*. The right side converts counterclockwise rotation facing left of the middle transfer gear 20*e* into clockwise rotation facing proximal of the middle crown gear 20*f*. Hence, if the middle transfer gear 20*e* rotates in either direction, the middle crown gear 20*f* rotates clockwise facing proximal.

The middle crown gear 20*e* engages the left gear coupling 24*a* and the right gear coupling 22*a*. The gear couplings have posts which engage their respective left racket 24*e* and right racket 22*e*. The rackets sometimes engage their respective left internal gear ring 24*c* and right internal gear ring 22*c* depending on the direction of rotation of the rackets. If the left racket 24*e* rotates clockwise facing left, the left racket 24*e* will engage the left internal ring gear 24*c*. Hence, the left internal ring gear 24*c* will also rotate clockwise facing left. If the left racket 24*e* rotates counterclockwise facing left, the left racket 24*e* will not engage the left internal gear 24*c*. Likewise, if the right racket 22*e* rotates counterclockwise facing left, the right racket 22*e* will engage the right internal ring gear 22*c*. Hence, the right internal ring gear 22*c* will also rotate counterclockwise. If the right racket 22*e* rotates clockwise facing left, the right racket 22*e* will not engage the right internal gear 22*c*.

It is noted, e.g., that the left internal ring gear 24*c* and the left crown gear 24*b* form the left crown gear integral component 24*d*. Likewise, the right internal ring gear 22*c* the right crown gear 22*b* form the right crown gear integral component 22*d*. Both crown gears engage with the middle crown gear 20*f*. If the left internal ring gear 24*c* is engaged, and therefore rotating clockwise facing left, then the middle crown gear 20*f* will rotate clockwise facing proximal. If the right internal ring gear 22*c* is engaged, and therefore rotating counterclockwise facing left, then the middle crown gear 20*f* will also rotate clockwise facing proximally. At no point are both rachets engaged as they engage in different directions of rotation. Therefore, regardless of the rotation of the middle transfer gear 20*e*, the middle crown gear 20*f* will always rotate clockwise facing proximal. Hence, the middle crown gear 20*f* will rotate clockwise facing proximal during forward and back strokes.

Figure 6:
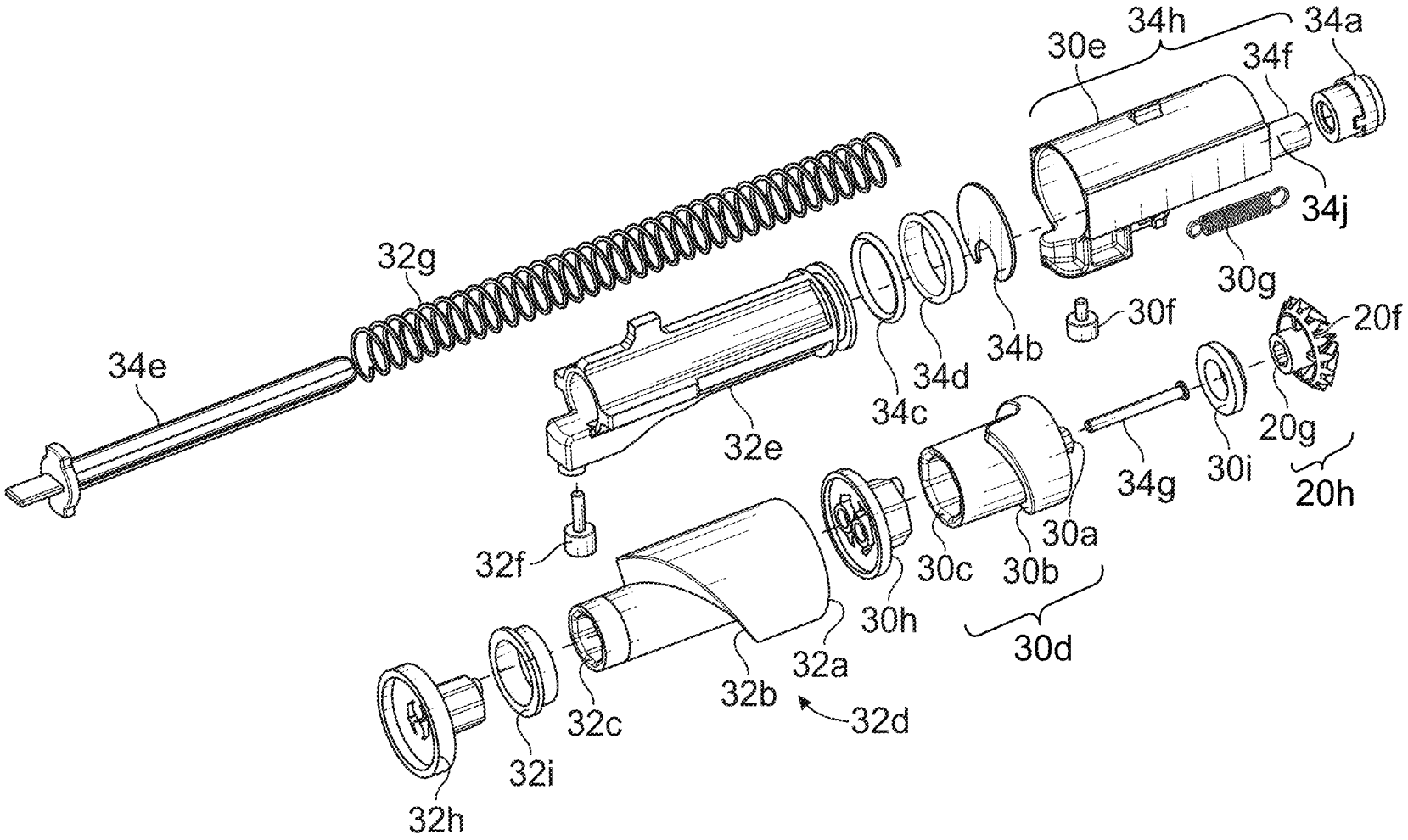
Figure 7:
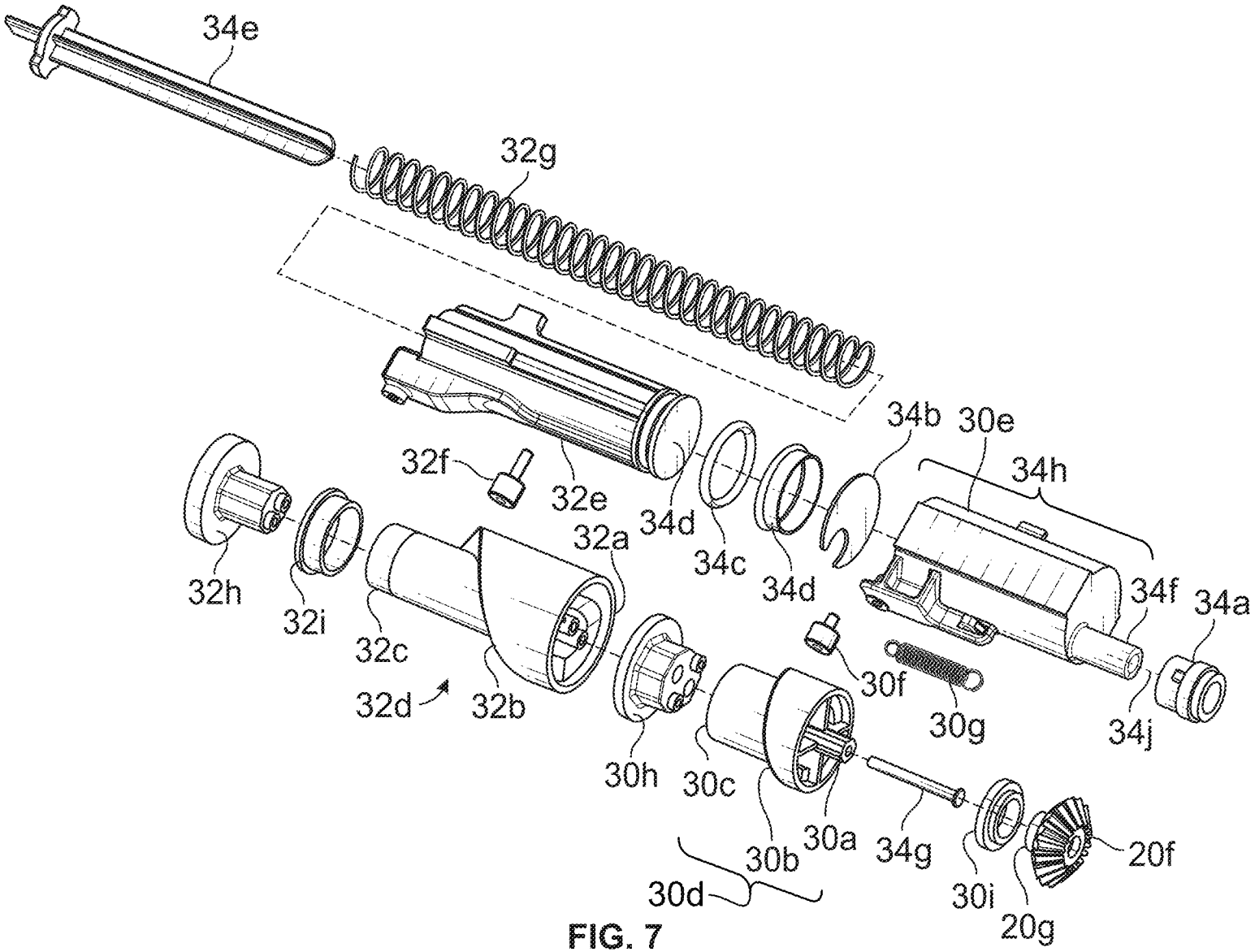

FIG. 6 and FIG. 7 show the cam follower part of the firing mechanism 18. The air compression element 34*h* is compromised of the cylinder follower 30*e* and the breech bolt 34*f*. The fluid communication channel 34*j* allows for fluid communication between the inside of the cylinder follower 30*e* and the distal end of the breech bolt 34*f*. In other words, the fluid communication channel 34*j* allows air to flow from the inside of the cylinder follower 30*e* through the distal end of the breech bolt 34*f*. The breech 34*i* slidably receives the breech bolt 34*f*.

To fire projectile rounds 38 the breech bolt 34*f* must advance into the breech 34*i*. However, for projectile rounds to enter the breech 34*i*, the breech bolt breech bolt 34*f* must be retracted from the breech 34*i*. Additionally, the breech bolt 34*f* pushes projectile rounds in the breech 34*i* through the breech bolt seal 34*a*.

The cylinder follower 30*e* slidably receives the piston follower 32*e*. If the cylinder follower 30*e* quickly slidably receives by the piston follower 32*e* then the pressure within the air compression element 34*h* will greatly increase. Fluid will expel through the distal end of the breech bolt 34*f* and the projectile round will be fired.

The cylinder cam 30*d* and piston cam 32*d* control the longitudinal position of the cylinder follower 30*e* and piston follower 30*e*. As previously mentioned, the followers are constrained to move longitudinally by the structural housing. The cams rotate along the longitudinal axis. Both cams have cam follower pathways; the cylinder cam 30*d* has a cylinder cam follower pathway 30*b* and a piston cam 32*d* has a piston follower pathway 32*b*. Both followers have a tracking end which tracks the cam follower pathways of their respective cams. The cylinder follower 30*e* has a cylinder follower tracking end 30*f* which tracks the cylinder cam follower pathway 30*b*. Likewise, the piston follower 32*e* has a piston follower tracking end 32*f* which tracks the piston cam follower pathway 32*b*.

Both the cylinder follower 30*e* and the piston follower 32*e* have a biasing force applied by the air compression element spring 30*g* and the piston spring 32*g*. Both springs connect to their respective followers and the structural housing. The piston spring post 34*e* ensures that the piston spring 32*g* is aligned.

The angle of the middle crown gear 20*f* controls the angle of the barrel cam 30*d* and the piston cam 32*d*. The cylinder cam 30*d* controls the longitudinal position of the cylinder follower 30*e*, which in turn determines whether the breech bolt 34*f* extends into the breech 34*i*. The piston cam 30*d* controls the longitudinal position of the piston follower 30*e*, which in turn controls when the projectile round is fired. Therefore, if the cylinder cam follower pathway 30*b* is offset from the piston cam follower pathway 32*b*, the breech bolt 34*f* will advance into the breech 34*i* at a different time than when the projectile round is fired.

The middle crown gear 20*f* drives both the cylinder cam 30*d* and piston cam 32*d*. The middle crown gear 20*f* and crown gear shaft coupling 20*g* are part of the same middle crown gear integral component 20*h*. The crown gear shaft coupling 20*g* couples with the distal cylinder shaft coupling 30*a*. The distal cylinder shaft coupling 30*a* and proximal cylinder shaft coupling 30*c* are part of the cylinder cam 30*d* integral component. The proximal cylinder shaft coupling 30*c* couples with the intermediate shaft coupling 30*h*. The intermediate shaft coupling 30*h* couples with the distal piston shaft coupling 32*a*. The distal piston cam shaft coupling 32*a* and proximal piston cam shaft coupling 32*c* are part of the piston cam 32*d* integral component. The distal piston shaft coupling 32*c* couples with the end cap shaft coupling 32*h*. As previously mentioned, the end cap shaft coupling 32*h* is received by the structural housing, but is free to rotate with respect to the structural housing.

Additionally, the cylinder washer 30*i* is between the proximal cylinder shaft coupling 30*c* and intermediate shaft coupling 30*h*. The piston washer 32*i* is between the distal piston cam shaft coupling 32*c* and the end cap shaft coupling 32*h*. The central support shaft 34*g* constrains and supports the middle crown gear integral component 20*h*.

Also, air compression O-ring 34*c* is a seal that prevents air from flowing around the piston follower 32*e* when the piston follower 32*e* is received by the air compression element 34*h*. The air compression sleeve 34*d* stabilizes the air compression element 34*h* due to downward air flow around the piston follower 32*e* during firing. The air compression sleeve 34*b* directions air into the breech 34*i* during firing.

Figure 8:
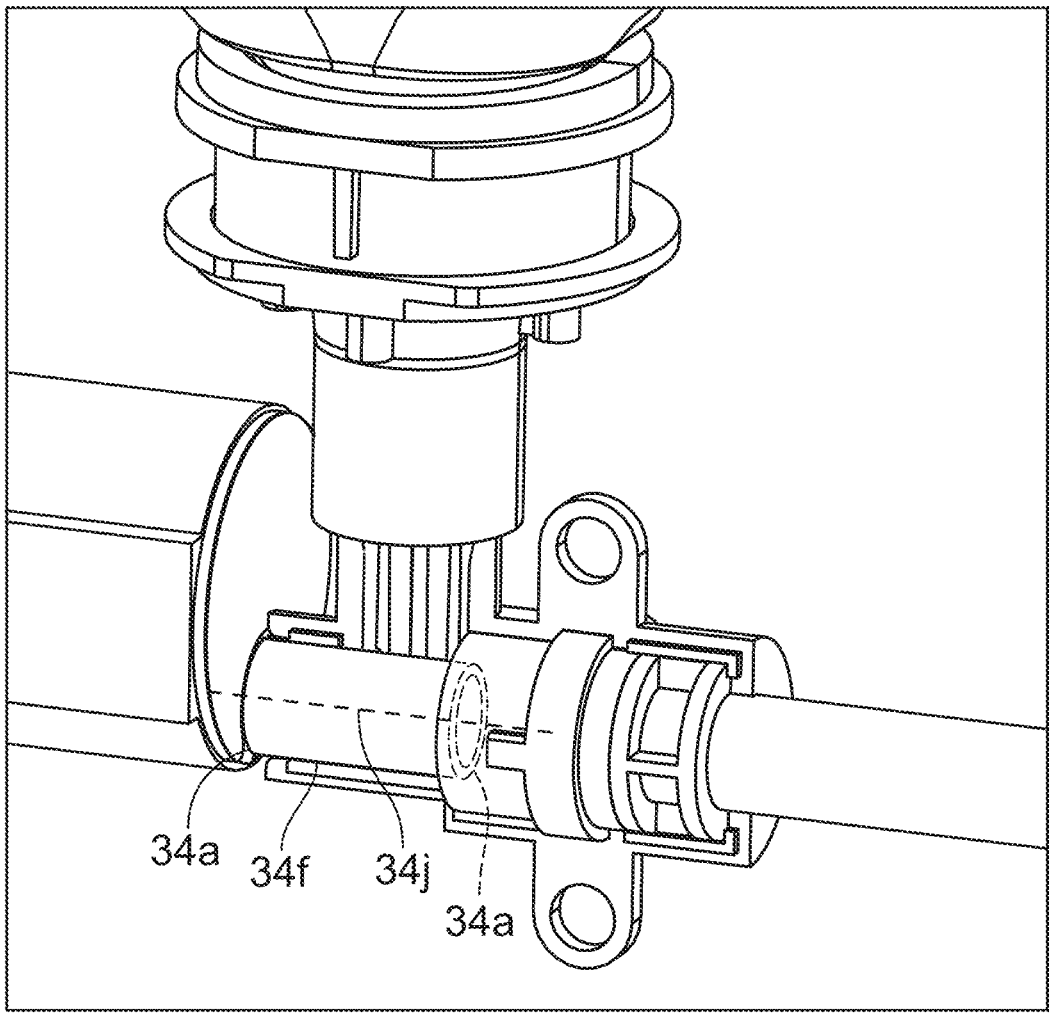
FIG. 8 illustrates an enlarged view of the breech, breech bolt, and breech bolt seal of the fluid communication channel.

FIG. 8 shows an enlarged view of the breech 34*i*, breech bolt 34*f*, the breech bolt seal 34*a* and the fluid communication channel 34*j* close in. The breech bolt 34*f* extends into breech 34*i*, but not through the breech bolt seal 34*a*. If there is a projectile round in the breech 34*i* and the breech bolt 34*f* advances, then the breech bolt 34*f* will push the projectile rounds 38 through the breech bolt seal 34*a*. The fluid communication channel 34*j* allows for fluid communication between the inside of the cylinder follower 30*e* and the distal end of the breech bolt 34*f*.

Figure 9:
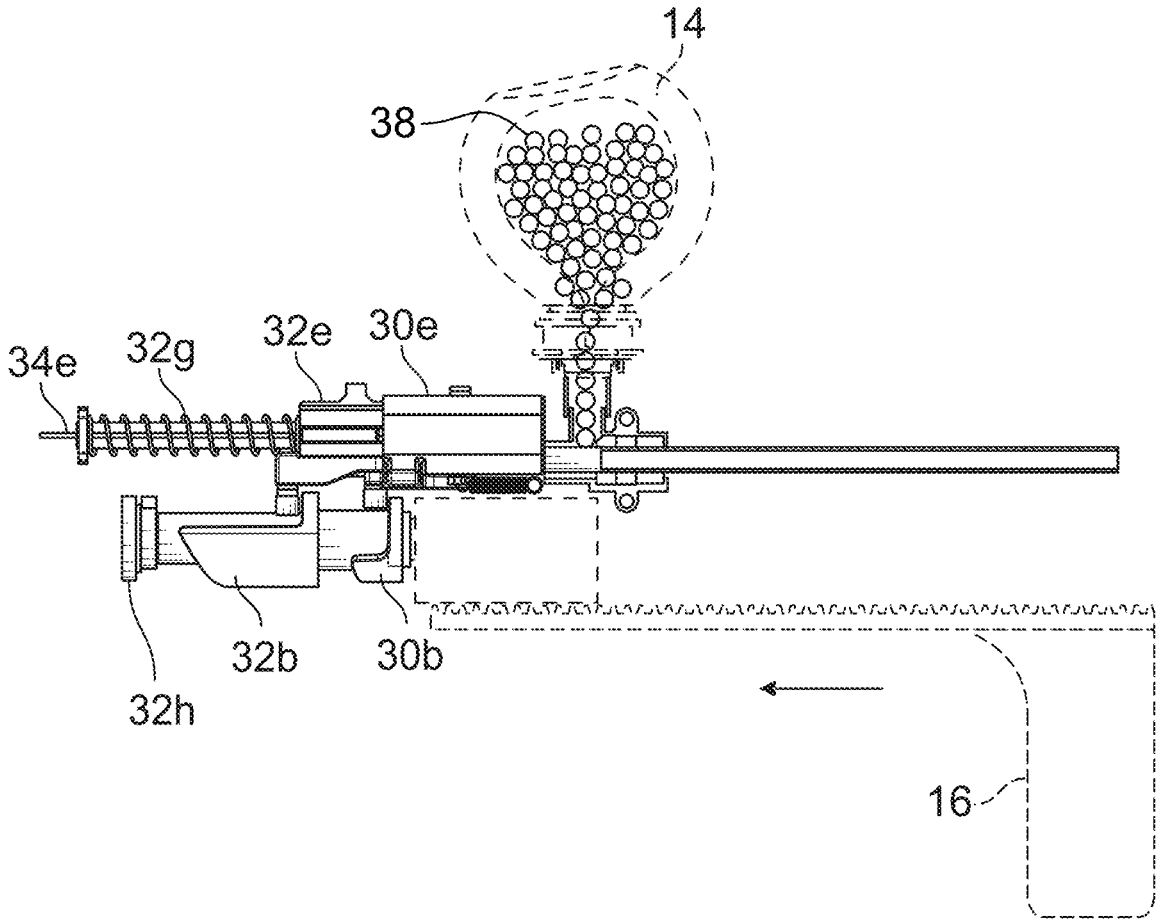
FIGS. 9 through 19 in sequence show the blaster embodiment in side-elevation firing mechanism sectional views with respective cylinder and piston cam pathway tracking/cam follower linkages advancing air compression element, cylinder and an elongated breech bolt, with the cylinder having a cylinder tracking end, the breech bolt having a proximal end at the cylinder and a breech bolt channel extending therethrough for fluid communication from the cylinder through the breech bolt for expelling compressed air from a distal end of the breech bolt, a breech spring being connected to and extending with the air compression element functionally operating to outwardly launch the one or more projectiles through the barrel seal and the projectile launching barrel.
Figure 10:
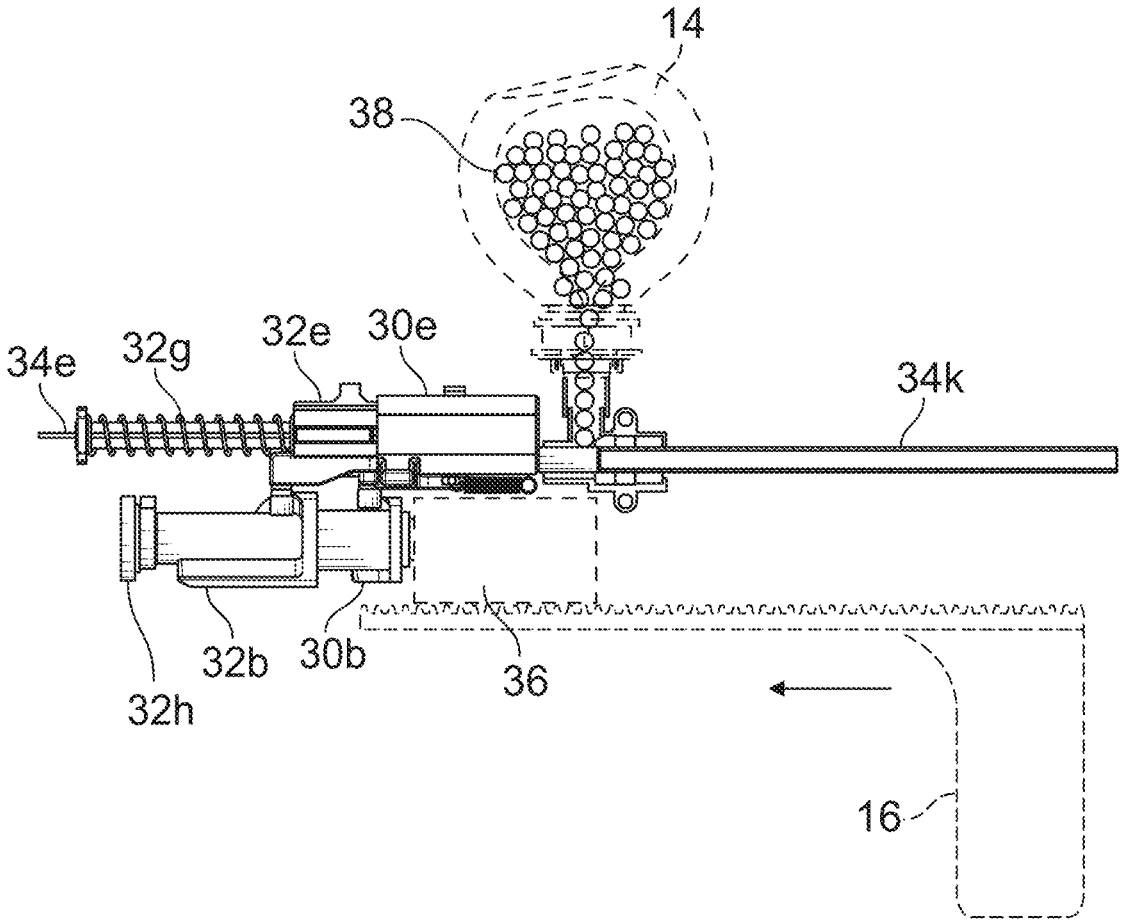
Figure 11:
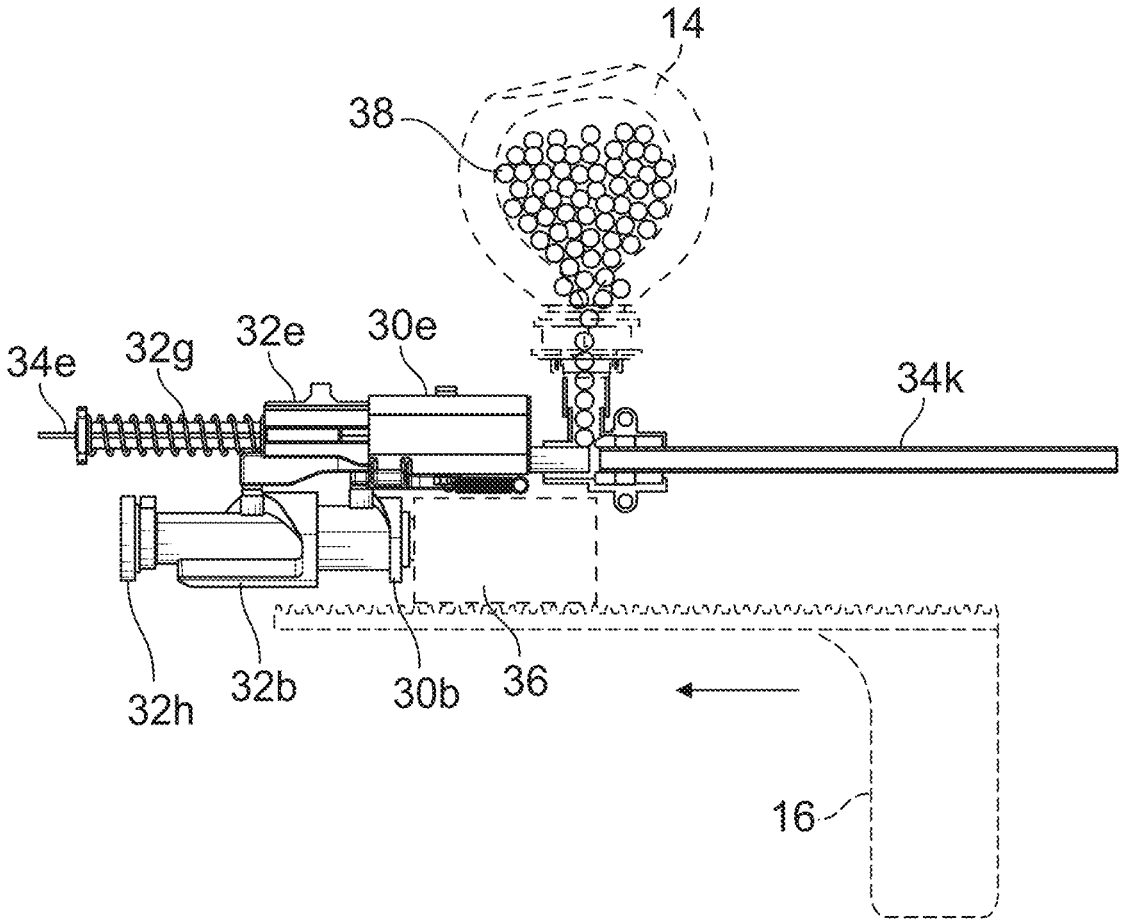
Figure 12:
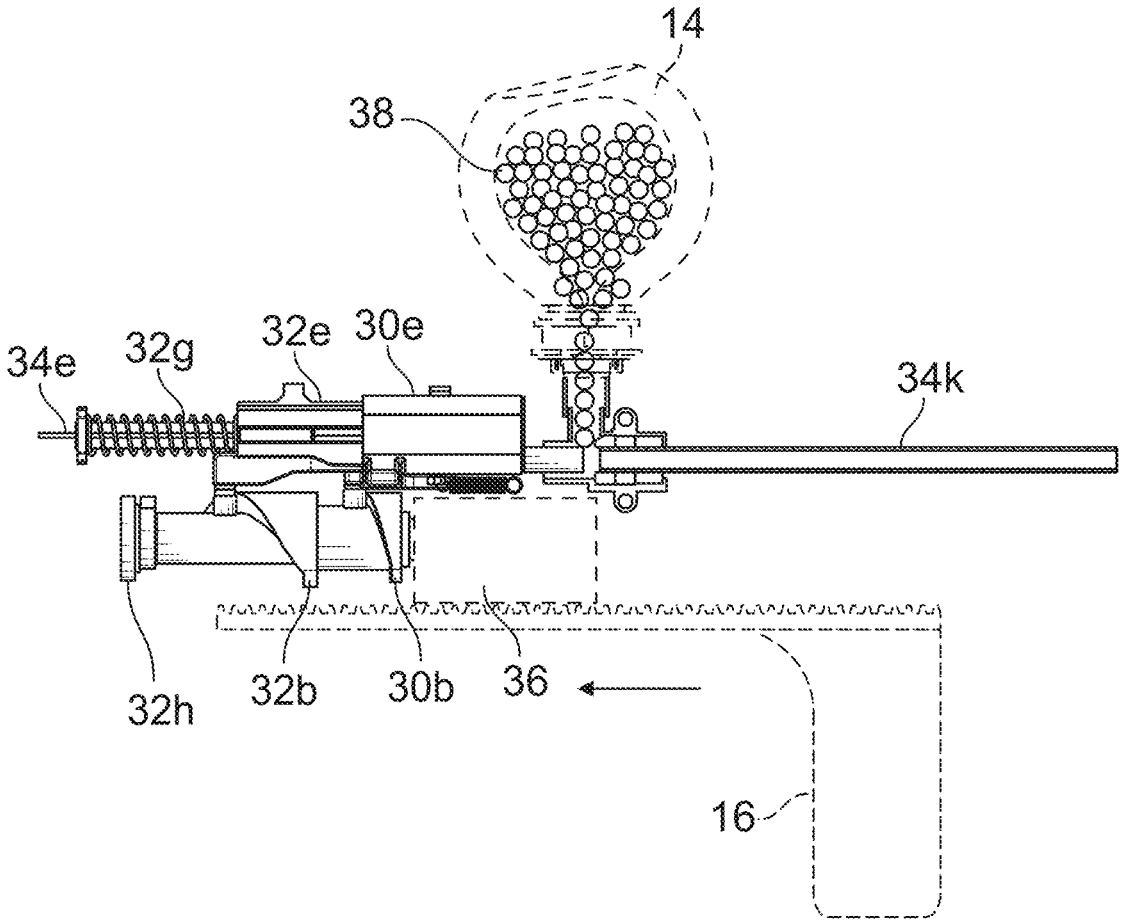
Figure 13:
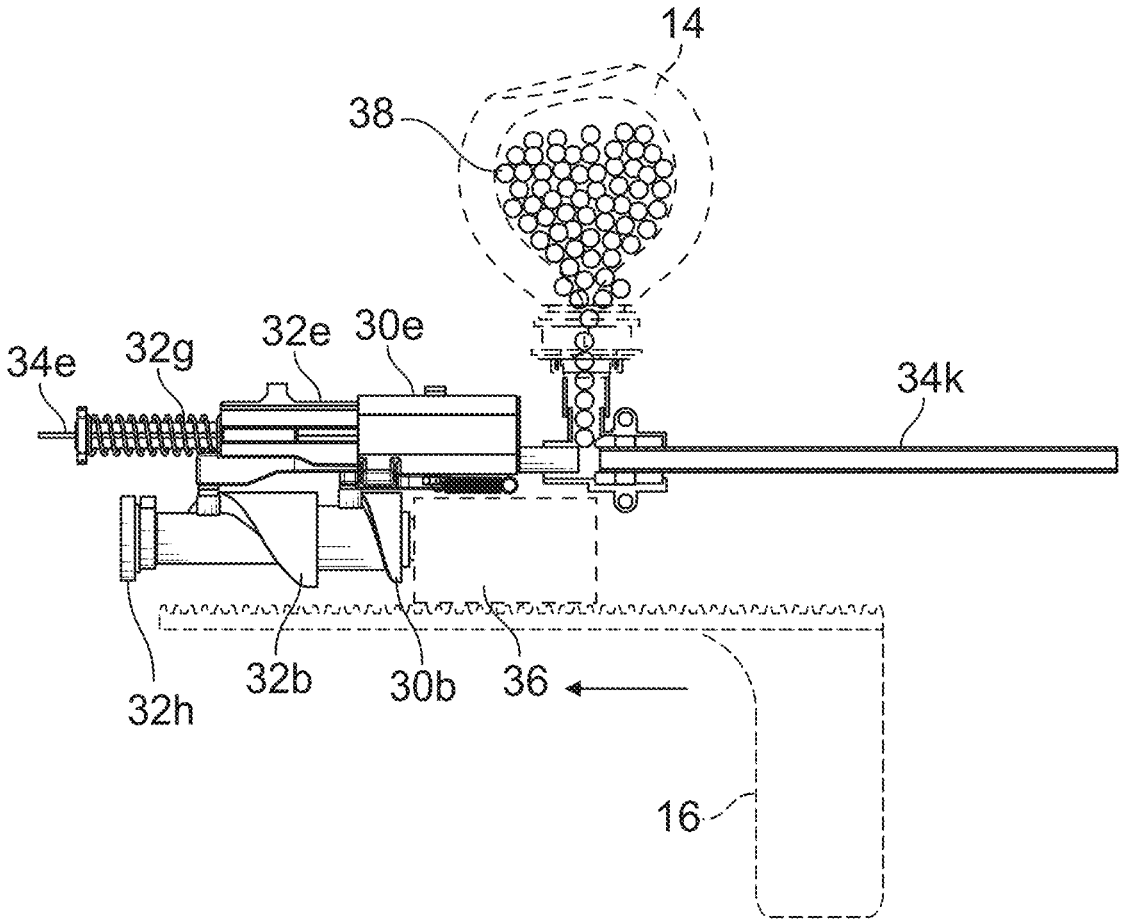
Figure 14:
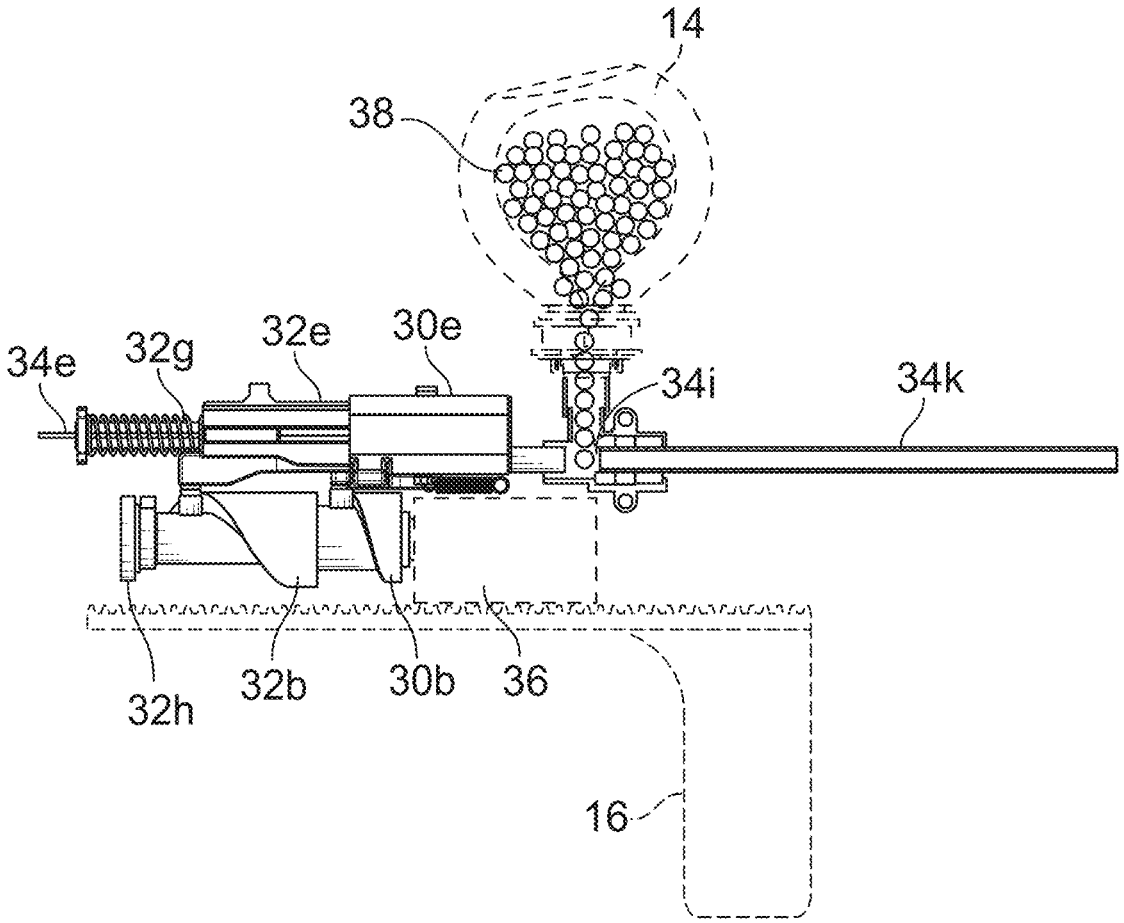

FIG. 9, et seq. show the blaster 10 firing through a back and forward stroke. The projectile rounds 38 are stored in hopper 14. These FIGS. 9 through 19 in sequence show the blaster embodiment in side-elevation firing mechanism sectional views with respective cylinder and piston cam pathway tracking/cam follower linkages advancing air compression element, cylinder and an elongated breech bolt, with the cylinder having a cylinder tracking end, the breech bolt having a proximal end at the cylinder and a breech bolt channel extending therethrough for fluid communication from the cylinder through the breech bolt for expelling compressed air from a distal end of the breech bolt, a breech spring being connected to and extending with the air compression element functionally operating to outwardly launch the one or more projectiles through the barrel seal and the projectile launching barrel. The generic rotary mechanism 36 converts the linear motion of the handle 16 in either direction to rotary motion in the clockwise direction facing proximal. FIG. 5 shows the generic rotary mechanism used in the embodiments. However, for the purposes of FIGS. 9 through 16, any source of rotary motion as such a motor can replace the generic rotary mechanism 36.

Figure 15:
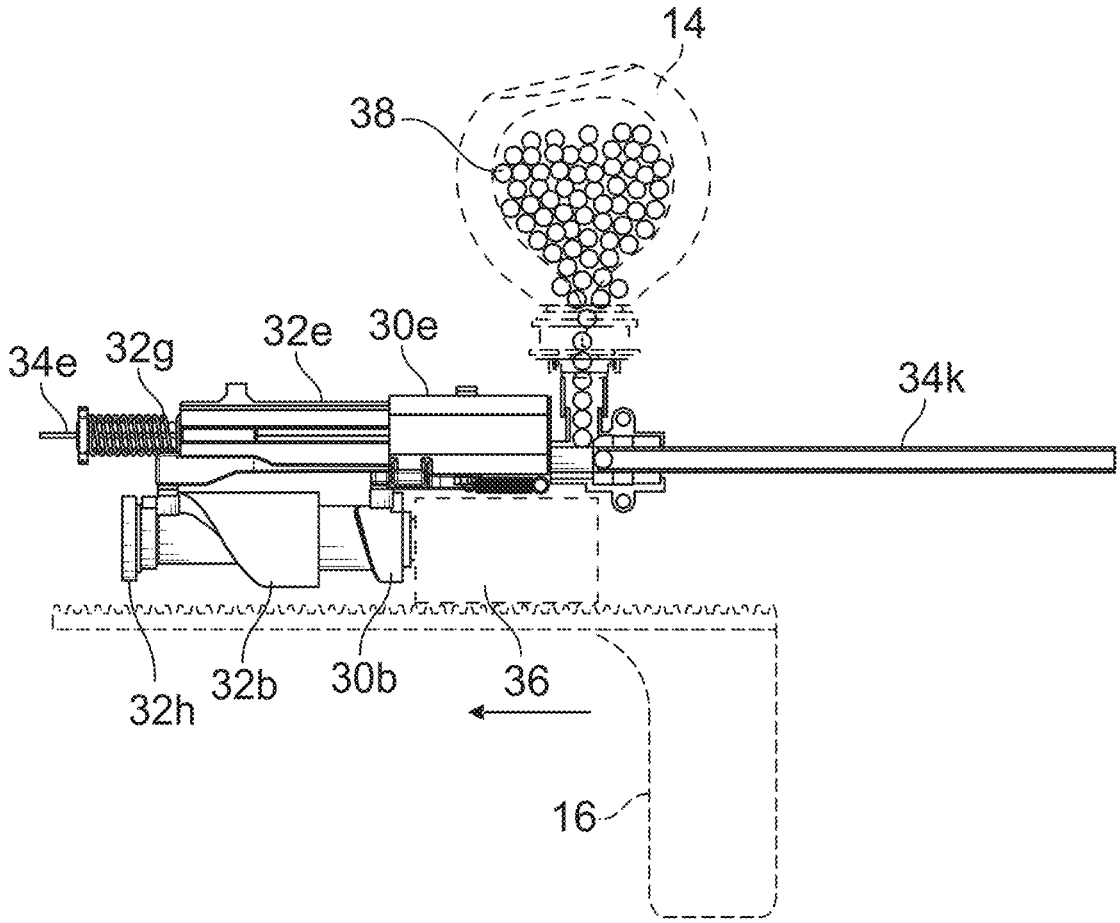
Figure 16:
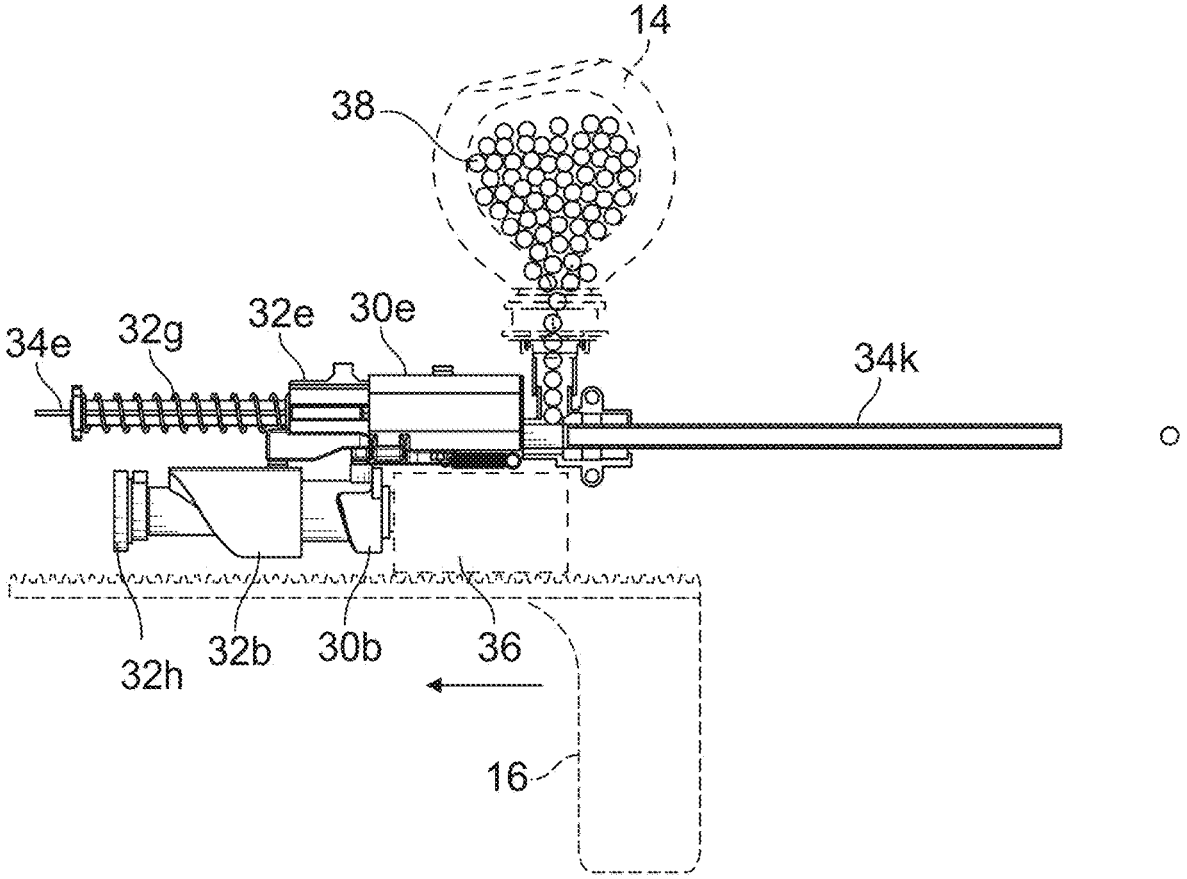

FIG. 9 shows the handle 16 fully advanced. The breech bolt 34*f* extends into the breech 34*i*. Therefore, no projectile rounds 38 may enter the breech 34*i*. FIG. 10, FIG. 11, FIG. 12, FIG. 13 and FIG. 14 show the handle 16 being retracted in a backstroke. First, the breech bolt 34*f* retracts from the breech 34*i*. By FIG. 14 the projectile rounds 38 may now enter breech 34*i*. In FIG. 15, the handle 16 retracts further and the breech bolt 34*f* extends into the breech 34*i*. In FIG. 16, the handle 16 retracts even further and the cylinder follower 30*e* quickly receives the piston follower 32*e*, which pneumatically fires the projectile round.

Figure 17:
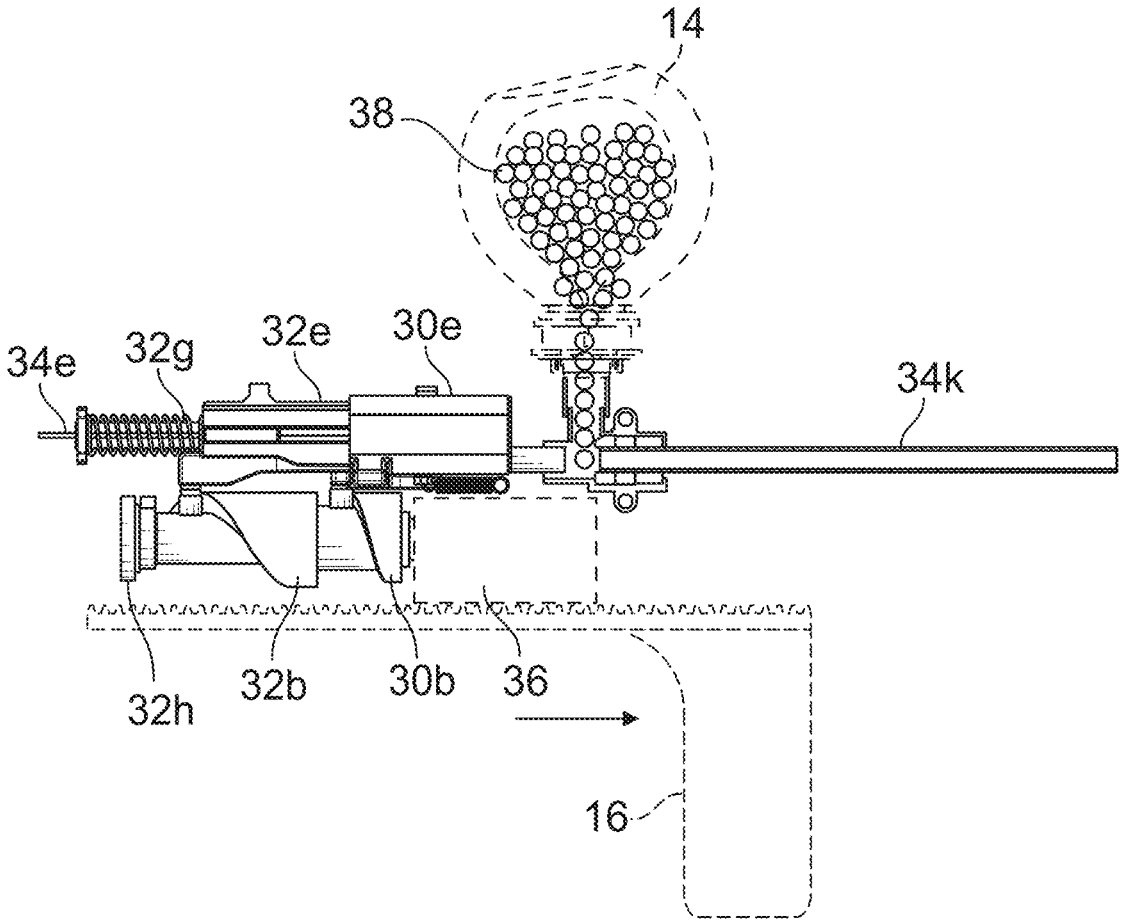
Figure 18:
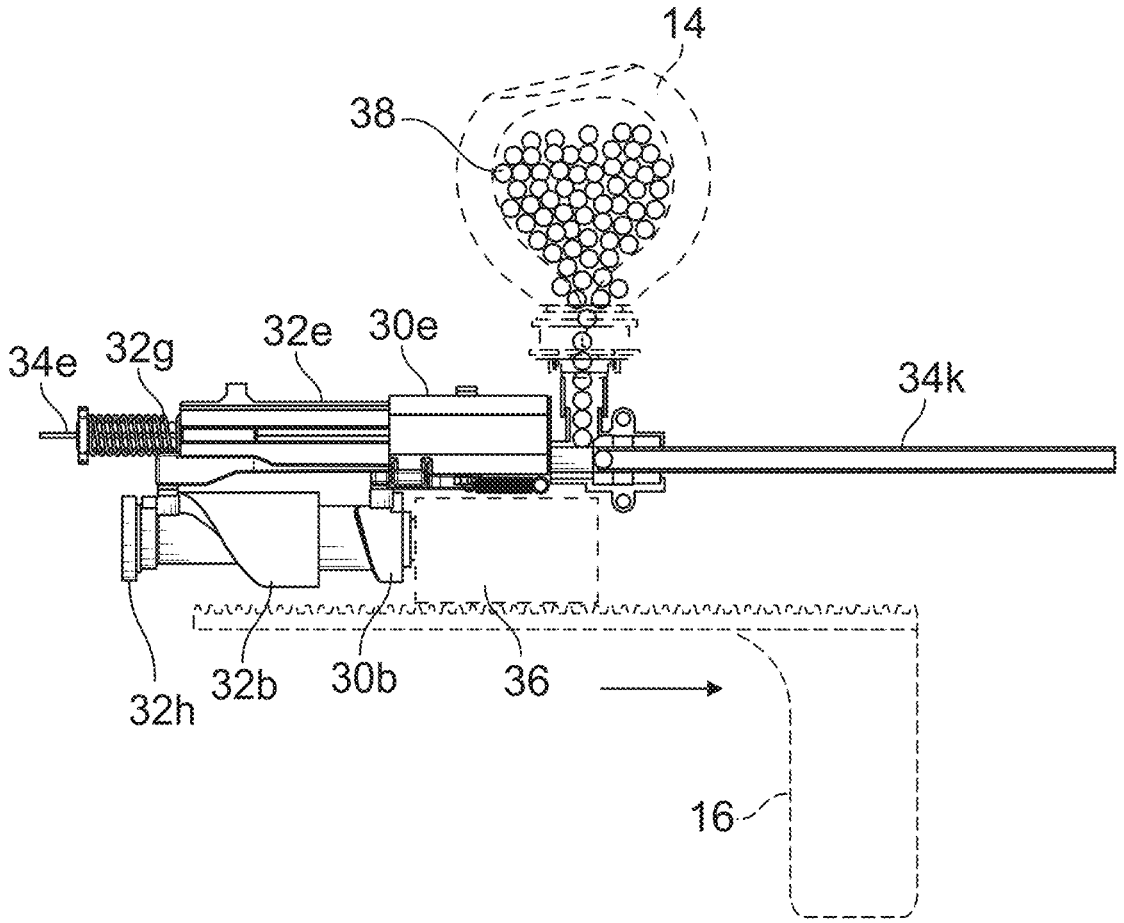
Figure 19:
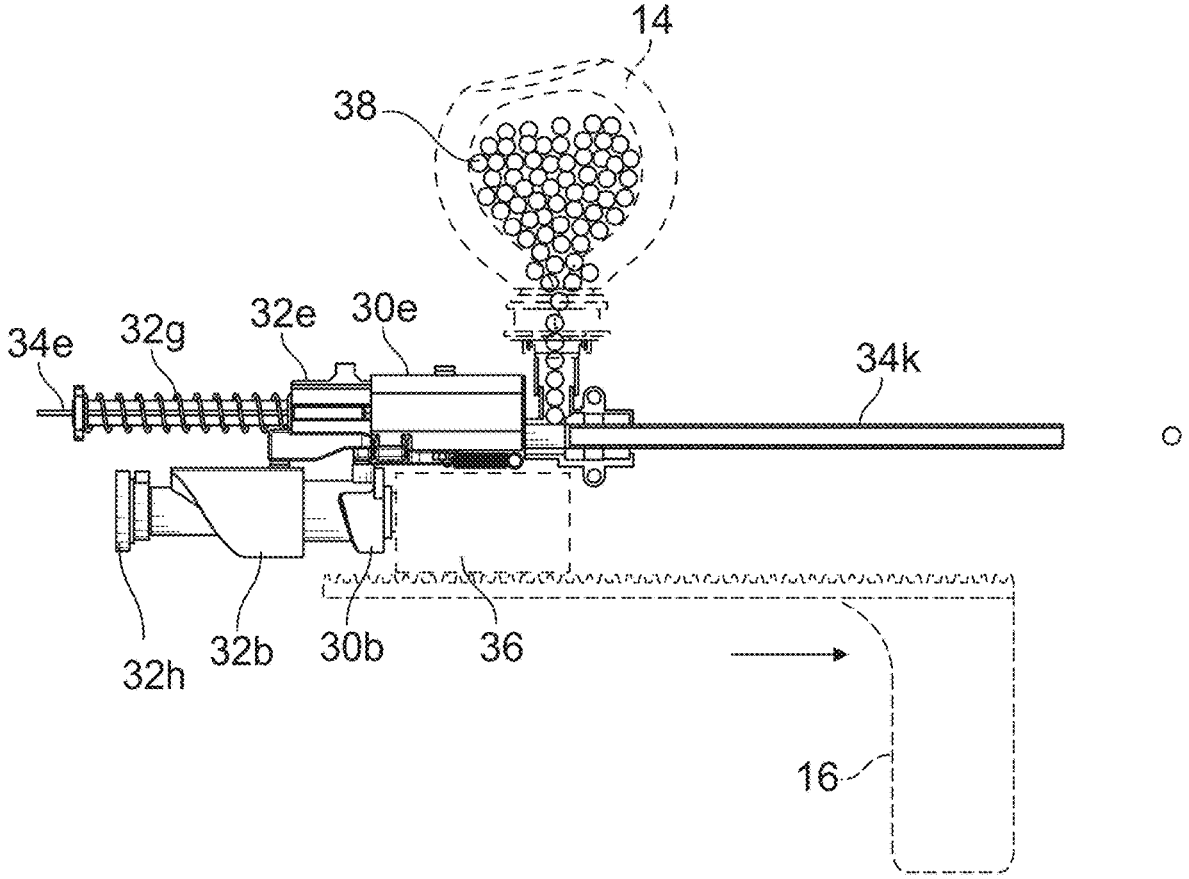

FIG. 17 shows the beginning of the forward stroke. Since the cams rotate in a single direction regardless of the direction of the handle, the same steps of firing may be repeated for the forward stroke. The firing cycle may repeat, or single cycle may be used. Since the handle 16 advances, the breech bolt 34*f* retracts from the breech 34*i*. A projectile round enters the breech 34*i*. FIG. 18 shows the handle 16 advancing further. The breech bolt 34*f* advances into the breech 34*i*. In FIG. 19, the handle 16 advances even further. The cylinder follower 30*e* quickly receives the piston follower 32*e*, which pneumatically fires the projectile round.

Figure 20:
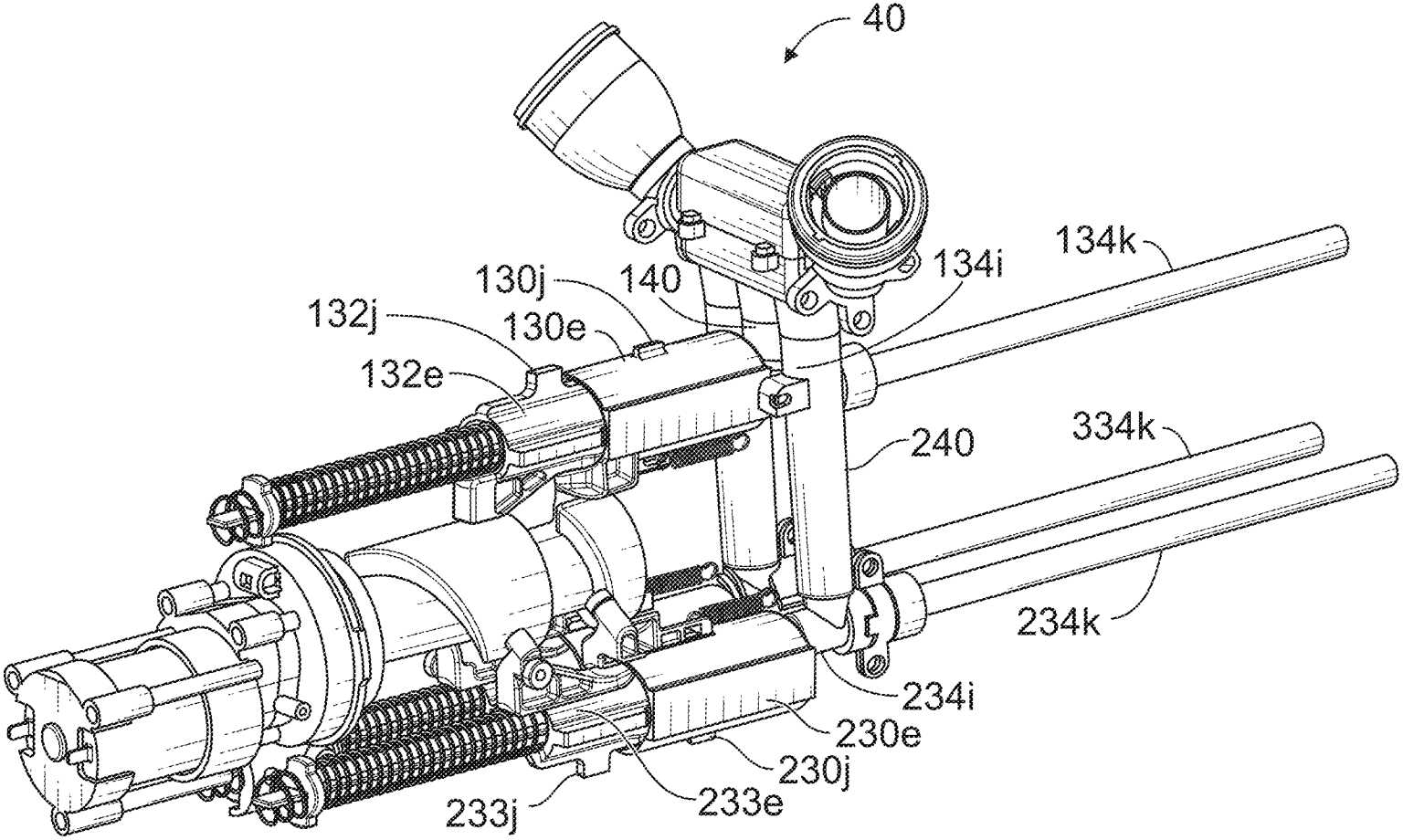
FIGS. 20 and 21 show partial isometric views of a further alternative embodiment with three barrels instead of a single barrel by adding two additional assemblies to contain three separate piston and cylinder followers around a central cylinder cams and piston cams, the three sets of followers moving 120 degrees out of sync with each other illustrating the cam pathway tracks/cam follower linkages functionally attached in accordance with the present inventions.
Figure 21:
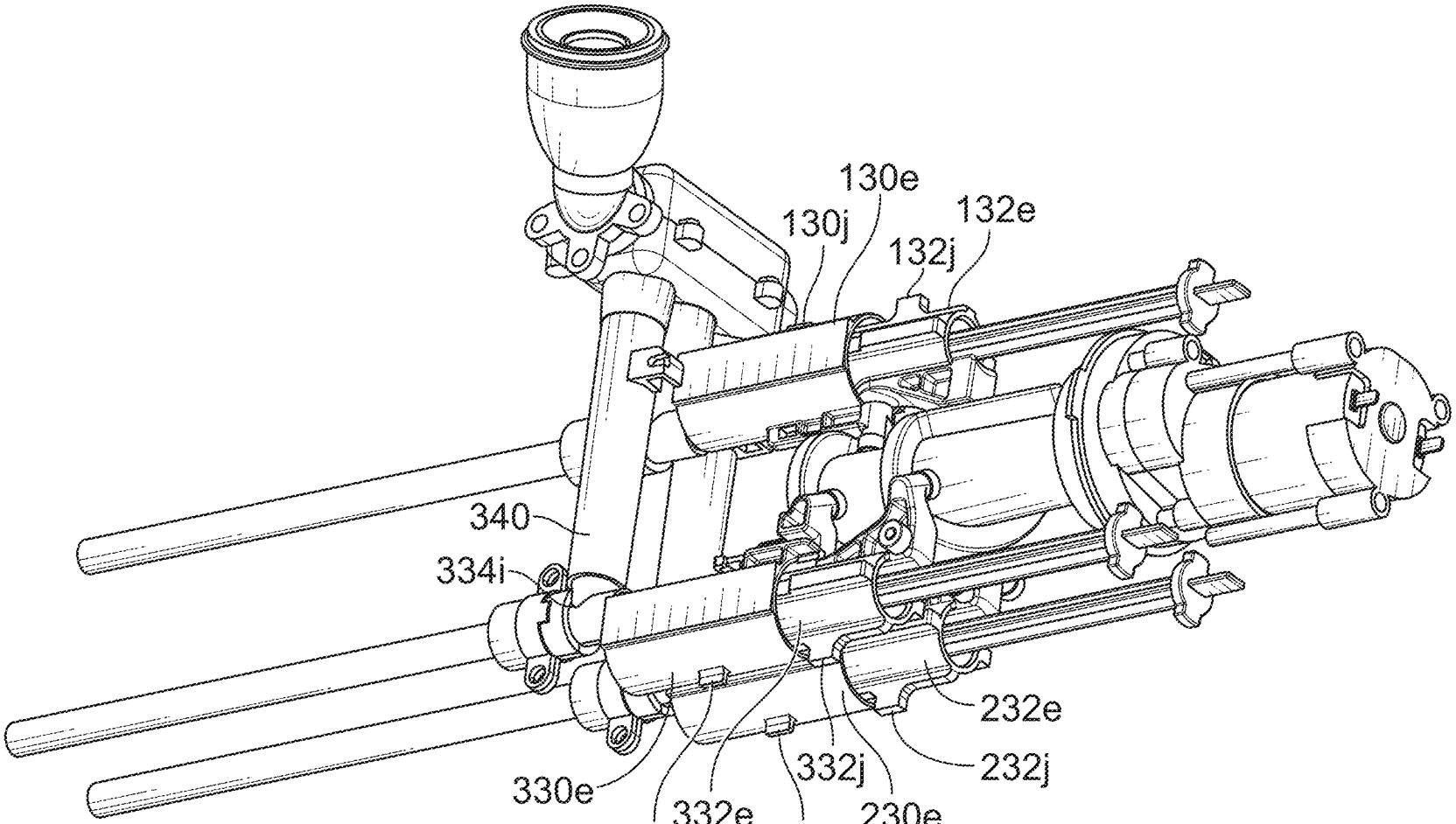

FIGS. 20 and 21 show an alternative embodiment with three (n=3; e.g., 134*k*, 234*k*, 334*k*) barrels instead of a single barrel. The embodiment contains three separate piston and cylinder followers around a central cylinder cam 30*d* and piston cam 32*d*. On the top, there is a top cylinder follower 130*e* and a top piston follower 132*e*. This allows for rapid sequential firings of projectile rounds 38 with rotation of the barrel cam driving multiple followers; n=3 is shown for illustrative purposes but any number of n barrels may be employed instead of a single barrel, e.g., any number of two or more n barrels may be employed. On the bottom right there is a right cylinder follower 230*e* and a right piston follower 232*e*. On the bottom left there is a left cylinder follower 330*e* and a right piston follower 332*e*. Projectile rounds are fed from the projectile round combiner 40 into via the top projectile round shaft 140 into the top breech 134*i*. Projectile rounds are fed from the projectile round combiner 40 into via the right projectile round shaft 240 into the right breech 234*i*. Projectile rounds are fed from the projectile round combiner 40 into via the left projectile round shaft 340 into the left breech 334*i*.

Just like in the single barrel embodiment, the followers are constrained to move longitudinally. The top cylinder follower tab 130*j* constrains the top cylinder follower 130*e* to translate longitudinally. The top piston follower tab 132*j* constrains the top piston follower 132*e* to translate longitudinally. The right cylinder follower tab 230*j* constrains the right cylinder follower 230*e* to translate longitudinally. The right piston follower tab 232*j* constrains the right piston follower 232*e* to translate longitudinally. The left cylinder follower tab 330*j* constrains the left cylinder follower 330*e* to translate longitudinally. The left piston follower tab 332*j* constrains the left piston follower 332*e* to translate longitudinally. The tabs are constrained by the structural housing.

There is a breech bolt at the distal end of each cylinder follower which advances into their own breech. Each breech bolt has a fluid communication channel that allows for fluid communication between the inside of their cylinder follower and the distal end of the breech bolt. The breech bolts must advance into their respective breeches to fire projectile rounds but must be retracted for the breeches to receive projectile rounds.

Also, each cylinder follower slidably receivers their respective piston follower: the top cylinder follower 130*e* slidably receives the top piston follower 132*e*, the right cylinder follower 230*e* slidably receives the right piston follower 232*e* and the left cylinder follower 330*e* slidably receives the right piston follower 332*e*. Each follower also tracks a cam follower pathway. The top cylinder follower 130*e*, right cylinder follower 230*e* and left cylinder follower 330*e* all track the cylinder cam follower pathway 30*b*. The top piston follower 132, right piston follower 232*e* and left piston follower 332*e* all track the cylinder cam follower pathway 32*b*. Also, all the followers have a biasing force applied.

The cam follower pathways cause the followers to translate similarly to the embodiment with only one barrel. The cylinder follower and its respective piston follower will both retract. Then, the cylinder follower will advance so that the breech bolt advances it into the breech. Next, the piston follower quickly advances, and the projectile round is fired. However, the three sets of followers are 120 degrees out of sync with each other.

Figure 22:
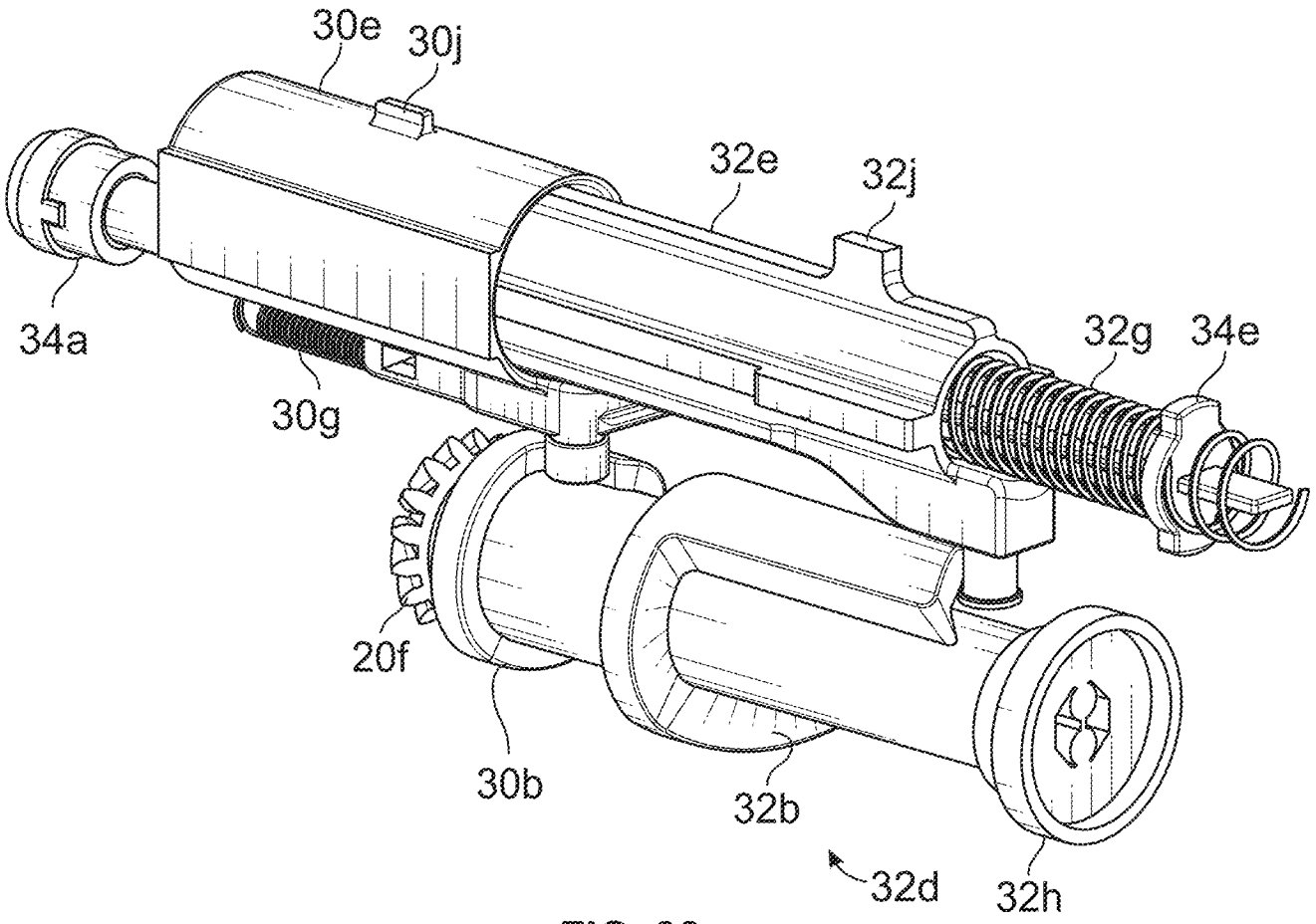
FIG. 22 illustrates angle offsets of the respective cylinder cam follower pathway, and the piston cam follower pathway use of the blaster firing mechanism in accordance with the present invention.

FIG. 22 shows the angle offset of the cylinder cam follower pathway 30*b* and the piston cam follower pathway 32*b*. From the view thereof, the ledge in cylinder cam follower pathway cam pathway 30*b* is farther than the ledge of the piston cam follower pathway 32*b*. Hence, when the cams rotate, the cylinder follower tracking end 30*f* will reach the ledge of the cylinder cam follower pathway 30*b* before the piston follower tracking end 32*f* reaches the ledge of the piston cam follower pathway 32*b*. Therefore, the breech bolt 34*f* will extend into the breech 34*i* before the piston follower 32*e* fires the projectile rounds 38.

While particular embodiments of the inventions have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launching apparatus, comprising:

a firing mechanism housing;

a projectile launching barrel;

an air compression element comprising a cylinder and an elongated breech bolt, with the cylinder having a cylinder tracking end, the breech bolt having a proximal end at the cylinder and a breech bolt channel extending therethrough for fluid communication from the cylinder through the breech bolt for expelling compressed air from a distal end of the breech bolt, a breech spring being connected to and extending with the air compression element;

a piston slidably received at the cylinder of the air compression element, with the piston having a piston tracking end;

a barrel cam assembly with at least one rotatably disposed peripheral surface with a cylinder cam pathway track and piston cam pathway track, the piston tracking end at the piston cam pathway track, and the cylinder tracking end at the cylinder cam pathway track;

a breech at the firing mechanism housing including at least one barrel seal aligned with the projectile launching barrel, the breech being capable of receiving one or more projectiles with the breech bolt of the air compression element capable of extending into the breech to position a received projectile through the barrel seal; and a mechanism for turning the barrel cam assembly.

2. The toy launching apparatus of claim 1, wherein the mechanism for turning the barrel cam assembly comprises a user operable handle.

3. The toy launching apparatus of claim 2, wherein the mechanism for turning further comprises converting linear motion in two directions into rotary motion in one direction, where the handle is used to fire projectiles during forward strokes and back strokes to rotate the barrel cam assembly upon translating the handle between fully advanced and retracted, the cylinder tracking end tracking the cylinder cam actuated by the rotation of the barrel cam for withdrawing the breech bolt of the air compression element from the breech.

4. The toy launching apparatus of claim 2, wherein the mechanism for turning further comprises a motor for imparting rotary motion in one direction, where the handle is a trigger switch to activate the motor to fire projectiles.

5. The toy launching apparatus of claim 1, comprising a hopper at the breech for feeding one or more projectiles received into the breech by gravity.

6. The toy launching apparatus of claim 1, comprising a cylinder follower at the cylinder tracking end, a piston follower at the piston tracking end, and a piston spring for priming compression with the piston follower at the piston tracking end actuated by the rotation of the barrel cam assembly.

7. The toy launching apparatus of claim 6, wherein the breech spring is connected to the air compression element whereupon further translating the handle releases the breech spring for extending the breech bolt into the breech.

8. The toy launching apparatus of claim 7, wherein further translating the handle releasing the piston spring for advancing the piston into the cylinder of the air compression element in the breech, causing compressed air to expel through the breech bolt channel extending through the breech bolt for expelling compressed air from the distal end of the breech bolt, and outwardly launch the one or more projectiles through the barrel seal and the projectile launching barrel.

9. A toy launching apparatus, comprising:

a firing mechanism housing;

a projectile launching barrel;

an air compression element comprising a cylinder and an elongated breech bolt, the breech bolt having a proximal end at the cylinder and a breech bolt channel extending therethrough for fluid communication from the cylinder through the breech bolt for expelling compressed air from a distal end of the breech bolt;

a breech spring connected between the air compression element and the firing mechanism housing;

a piston slidably received at the cylinder of the air compression element, with a piston spring connected between a piston tracking end piston follower and the firing mechanism;

a barrel cam defining a cylinder pathway track and piston pathway track, the piston tracking end at the piston cam pathway track, the piston spring biased to extend with the piston cam pathway track movement imparted to the piston;

a cylinder tracking end at the cylinder cam pathway track, the breech spring biased to extend with the cylinder cam pathway track movement imparted to the cylinder and the elongated breech bolt of the air compression element; and a breech at the firing mechanism housing including at least one barrel seal aligned with the projectile launching barrel, the breech being capable of receiving one or more projectiles with the breech bolt of the air compression element capable of extending into the breech to position a received projectile through the barrel seal.

10. The toy launching apparatus of claim 9, comprising a hopper at the breech for receiving one or more projectiles by gravity for feeding into the breech.

11. The toy launching apparatus of claim 10, wherein the breech spring releases the breech spring for extending the breech bolt into the breech with the cylinder cam pathway track movement imparted to the cylinder and the elongated breech bolt of the air compression element.

12. The toy launching apparatus of claim 11, wherein the piston spring at the piston is biased for compression by the piston follower contacting the piston cam follower pathway actuated by the rotation of the barrel cam.

13. The toy launching apparatus of claim 12, comprising a breech spring at cylinder follower contacting the cylinder cam follower pathway actuated by the rotation of the barrel cam for withdrawing the breech bolt of the air compression element from the breech of the pre-firing area.

14. The toy launching apparatus of claim 13, further comprising a handle where pulling of the handle releases the breech spring for extending the breech bolt of the air compression element into the breech.

15. The toy launching apparatus of claim 14, comprising a mechanism for turning the barrel cam with a motor, wherein the handle is a trigger switch to activate the motor to fire projectiles and pulling thereof releases the piston spring for advancing the piston into the cylinder of the air compression element in the breech.

16. The toy launching apparatus of claim 14, wherein the handle releases the piston spring for advancing the piston into the cylinder of the air compression element in the breech causing compressed air to expel through the breech bolt channel extending through the breech bolt for expelling compressed air from the distal end of the breech bolt, and outwardly launch one or more projectiles through the projectile launching barrel.

17. A toy launching method, comprising the steps of:

providing a receptacle for receiving multiple projectile rounds for launching with a firing mechanism housing through a projectile launching barrel;

an air compression step using a cylinder having a cylinder tracking end, and an elongated breech bolt having a channel extending therethrough for fluid communication from the cylinder through the breech bolt for expelling compressed air;

receiving a piston slidably in the cylinder of the air compression element, with the piston having a piston tracking end; and rotating a barrel cam defining a cylinder cam pathway track and piston cam pathway track, the piston tracking end at the piston cam pathway track, and the cylinder tracking end at the cylinder cam pathway track.

18. The toy launching method of claim 17, further comprising:

defining a barrier and hopper area inside the receptacle, allowing for a user to agitate one or more received multiple projectile rounds beyond the barrier and into the hopper area with at least one of the received projectiles being aligned therein by gravity;

connecting a breech spring to the firing mechanism housing, the breech spring biased to extend with the cylinder and the elongated breech bolt; and defining a breech at the firing mechanism housing including at least one barrel seal aligned with the projectile launching barrel, positioning the at least one of the received projectiles with the elongated breech bolt extending into the pre-firing area at the least one barrel seal.

19. The toy launching method of claim 18, providing a turning mechanism for converting linear motion in two directions into rotary motion in one direction, with a handle used to fire projectiles during forward strokes and back strokes to rotate the barrel cam upon translating the handle between fully advanced and retracted, the cylinder tracking end tracking the cylinder cam actuated by the rotation of the barrel cam.

20. The toy launching method of claim 18, providing a motorized turning mechanism for imparting rotary motion, with a trigger switch to activate the motor to rotate the barrel cam, the cylinder tracking end tracking the cylinder cam actuated by the rotation of the barrel cam to fire projectiles.

* * * * *